US009426576B2

(12) United States Patent
Gladwin et al.

(10) Patent No.: US 9,426,576 B2
(45) Date of Patent: Aug. 23, 2016

(54) LOUDSPEAKER AND ELECTRODYNAMIC ACOUSTIC TRANSDUCER WITH BULBOUS WAVEGUIDE TIP

(71) Applicants: Timothy A Gladwin, Pakenham (CA); Jason B Cochrane, Arnprio (CA)

(72) Inventors: Timothy A Gladwin, Pakenham (CA); Jason B Cochrane, Arnprio (CA)

(73) Assignee: Definitive Technology, LLC., Owings Mills, MD (US)

( * ) Notice: Subject to any disclaimer, the term of this patent is extended or adjusted under 35 U.S.C. 154(b) by 0 days.

(21) Appl. No.: 14/631,031

(22) Filed: Feb. 25, 2015

(65) Prior Publication Data

US 2015/0172818 A1 Jun. 18, 2015

Related U.S. Application Data

(63) Continuation of application No. 13/162,294, filed on Jun. 16, 2011, now Pat. No. 8,995,697.

(60) Provisional application No. 61/355,433, filed on Jun. 16, 2010.

(51) Int. Cl.

| | |
|---|---|
| ***H04R 1/20*** | (2006.01) |
| ***H04R 7/02*** | (2006.01) |
| ***H04R 3/12*** | (2006.01) |
| ***H04R 9/04*** | (2006.01) |
| *H04R 1/26* | (2006.01) |
| *H04R 1/40* | (2006.01) |
| *H04R 3/14* | (2006.01) |

(52) U.S. Cl.
CPC *H04R 7/02* (2013.01); *H04R 3/12* (2013.01); *H04R 9/04* (2013.01); *H04R 1/26* (2013.01); *H04R 1/403* (2013.01); *H04R 3/14* (2013.01); *H04R 2201/34* (2013.01)

(58) Field of Classification Search
CPC .. H04R 1/28; H04R 1/2807; H04R 2201/34; H04R 9/04; H04R 3/12; H04R 3/14; H04R 1/403
See application file for complete search history.

(56) References Cited

U.S. PATENT DOCUMENTS 4,965,839 A * 10/1990 Elieli ..... H04R 1/24 381/184
6,714,656 B1 * 3/2004 Coffin ..... H04R 9/02 381/412

* cited by examiner

*Primary Examiner* — Tuan D Nguyen
(74) *Attorney, Agent, or Firm* — J. Andrew McKinney, Jr.; McKinney & Associates, LLC

(57) ABSTRACT

An electrodynamic acoustic transducer has a diaphragm and a frame with a pole piece carrying a bulbous waveguide tip which reduces or eliminates high frequency distortions caused by destructive interference within the transducer. The bulbous-tip structure clears the moving parts of the transducer and minimizes diffraction of sound energy, extending forward approximately to the plane defined by the outer periphery of the diaphragm when the diaphragm and voice coil are at rest. The bulbous-tip waveguide member extends radially outward above the central radiating area of the transducer diaphragm or cone so as to obscure the center portion of the diaphragm.

18 Claims, 17 Drawing Sheets

PRIOR ART WOOFER WITH DUSTCAP

PRIOR ART WAVEGUIDE WOOFER

LOUDSPEAKER AND ELECTRODYNAMIC ACOUSTIC TRANSDUCER WITH BULBOUS WAVEGUIDE TIP

PRIORITY CLAIMS AND REFERENCE TO RELATED APPLICATIONS

This application is a Continuation of U.S. patent application Ser. No. 13/162,294 of Timothy A. Gladwin, filed Jun. 16, 2011 and entitled "Bipolar Speaker with Improved Clarity", and also claims benefit of U.S. Provisional Patent Application No. 61/355,433, filed Jun. 16, 2010 and entitled "Loudspeaker Driver and Bipolar System", the disclosures of which is hereby incorporated herein in their entireties by reference. This application is directed to improvements on the transducers in the Bipolar Array Loudspeaker system described in commonly-owned U.S. Pat. No. 5,887,068, and the Electrodynamic Acoustic Transducer described in U.S. Pat. No. 7,684,582, the disclosures of which are also hereby incorporated herein in their entireties by this reference.

BACKGROUND OF THE INVENTION

1. Field of the Invention

The present invention relates, in general, to apparatus and methods for improving the acoustical performance of high-fidelity loudspeaker transducers.

2. Discussion of Related Art

Listeners using loudspeaker systems ("speakers") in normal circumstances hear both the direct sound radiation from the speaker and a reflected sound field from reflections from the room boundaries and objects. In music reproduction, the reflected sound field is primarily responsible for the desirable sensation of "spaciousness". Speakers which enhance the reflected sound field in the listening room will impart a greater sense of spaciousness to the music than speakers which do not enhance the reflected sound field. However, if the reflected sound field is too intense, it may cause sound coloration and reduce the localization and clarity. For music, listeners universally prefer the highly spacious reflected sound of rear firing loudspeakers to the more direct sound of front firing loudspeakers. In the monophonic era, some enthusiasts deliberately aimed the speakers away from the audience to create a directionally enriched sound field. (see, e.g., F. Toole, *Sound Reproduction*, p 126, 2008). Research has also shown that, for speech, most listeners prefer a lower ratio of reflected to direct sound, although the optimum reflected sound level is still above the direct sound level. (see, W. Klippel: *Acoustica* 70 p 45-54 1990).

Prior art loudspeakers range from products that are highly directional to almost completely omni-directional. Highly directional loudspeakers provide too much direct sound field to the listener and are lacking in important near reflections that have been shown to improve clarity and intelligibility in addition to adding spaciousness. (see Bradley et al., *Journal of the Acoustical Society of America,* 113 (6), pp 3233-3244, 2003). The first reflections from highly directional loudspeakers are likely to come from surfaces behind the listener which can reduce the clarity, intelligibility and impression of space. Others have noted that omni-directional speakers produce so much reflected sound that they can "deliver a hopelessly confused stereo image when positioned in a typical living room". (G. L. Augspurger, Paper Number: 8-022 AES Conference: 8th International Conference: The Sound of Audio (May 1990)). Specifically, research has shown that too much front wall reflection can cause sound coloration and reduce the localization (see also, F. Toole, *Sound Reproduction* p 116, 2008).

Bipolar loudspeakers exhibit acoustic characteristics between the extremities of highly directional and omni-directional loudspeakers. Bipolar loudspeakers have one set or array of transducers or drivers facing forward to provide the direct sound, and a second identical set of transducers facing rearward in phase to enhance the reflected sound field. The reflected sound field consists of reflected sound from the rear transducers and reflected off-axis sound from the front transducers. Bipolar loudspeakers attempt to balance the clarity requirements for speech reproduction with the spatial requirements for music reproduction, and although they can achieve excellent spaciousness, nevertheless improved speech clarity and reduced sound colorization is desirable.

In 1990 Wolfgang Klippel published the results of a series of experiments where he determined that the "feeling of space" ranks with sound quality as the most important two factors in listener preference. Klippel measured this by running tests first with the speakers facing the listener to obtain a "relatively direct" sound field. Then he reversed the same loudspeakers so that they faced away from the listener create a vast reflected sound field. Klippel found that listeners overwhelmingly preferred the front firing speakers for speech, but the rear firing orientation for music. The primary feature of such bipolar speakers, then, is that the polar response of the speaker influences how the speaker interacts with the room, and it is this interaction, and most particularly the first reflections, that impart a sense of spaciousness to the sound produced by the speaker system.

However, test data now indicates that certain of these first reflections may improve clarity and yet others may reduce clarity. Typically, loudspeakers are "voiced" either by ear, by measurements, or a combination of the two methods. The most common, and generally considered the most important, measurement is the on-axis free-field (anechoic) Sound Pressure Level (SPL) vs. frequency response. However, in a bipolar speaker, there are several interactions between the front and back sound field which disturb the SPL measurement that is made by a microphone. Since humans do not listen as a microphone, humans interpret the complex sound field from a bipolar speaker as an improved sense of spaciousness, but also are sensitive to anomalies that produce distortions in the perceived sound.

In addition, currently available high quality electro-acoustic cone diaphragm transducers, such as may be used in the bipolar systems described above, create additional problems, in that they have deficiencies in their high frequency performance, for at high frequencies destructive interference due to the depth of the cone diaphragm causes irregularities in the frequency response. A waveguide may be used to fill the cone cavity and reduce the high frequency irregularities from the destructive interference, but prior art waveguides, which are tapered towards the front of the transducer with a bullet shaped or cone shaped tip, do not prevent destructive interference from the central section of the diaphragm. Thus, there is a need in high performance audio applications for loudspeaker transducers that reduce or eliminate high frequency distortions caused by destructive interference within the transducer.

Various bipolar, dipolar and "omni-directional" speaker systems from a number of manufacturers have attempted to overcome the foregoing perceived distortions by modifying the rear speaker spectral response, by pointing the speakers upwardly, or by using "reflectors" of dubious acoustic effect to "redirect" the sound field, with varying degrees of success. Other approaches have involved the use of wide front baffles to minimize the interaction of the acoustical output from the front and rear speakers, and in the above-referenced commonly-owned U.S. Pat. No. 5,887,068 to Givogue et al, wherein at least one side-mounted speaker was provided in a rectangular enclosure intermediate the front and rear mounted drivers to provide a configuration intended correct undesirable reinforcement and cancellation in acoustical output that occurs over certain frequency ranges.

The Givogue '068 patent teaches the methods to build a bipolar speaker that should produce a measured smooth, flat, on-axis, anechoic SPL curve for the entire speaker. The design trade-offs needed to realize a speaker meeting the objectives of the Givogue patent are not optimal for achieving the overall sound quality goals met sought by the applicants when developing the Bipolar loudspeaker system of the present invention, however. Givogue's side firing driver may be considered spurious to optimum performance of a BP speaker. Specifically, the artifacts in the measured curve that the Givogue patent attempts to improve are too high in frequency for the side firing speaker (subwoofer) to reproduce without introducing distortion of its own. In all practical applications the side firing driver is low-pass-filtered below the midrange (e.g., less than or below 200 Hz) which is where all the spatial effects really begin to work and where the ripples appear in the measured SPL. Second, the Givogue patent teaches use of independent frequency dividing networks for the front and back drivers specifically to flatten the anechoic on-axis frequency response, with no regard to the individual arrays' front and back frequency response and tonal balance. In practice, this leads to speakers with a rear tonal balance which is quite different from the front tonal balance. The rear SPL of a speaker conforming to the Givogue method is typically deficient in the lower midrange which makes the perception that such a speaker sounds harsh and lacks clarity.

There is a need, therefore, for a loudspeaker transducer configuration and method which overcomes the problems with the prior art and provides a loudspeaker system and improved transducer that reduces or eliminates high frequency distortions caused by destructive interference within the transducer, a more enjoyable sound quality for listeners using these loudspeaker systems in rooms and living spaces.

SUMMARY OF THE INVENTION

It is, therefore, an object of the present invention to overcome the problems with the prior art and provide an enhanced loudspeaker system and improved transducer that reduces or eliminates high frequency distortions caused by destructive interference within the transducer, a more enjoyable sound quality for listeners using these loudspeaker systems in rooms and living spaces.

It is another object of the invention to improve the linearity and high frequency performance of a high quality electro-acoustic cone diaphragm transducer or loudspeaker driver, by providing a waveguide with a linearity enhancing bulbous-tip shape.

The exemplary loudspeaker system embodiment illustrating one application of the bulbous-tip waveguide transducer is a bipolar loudspeaker system of which has been demonstrated to provide a substantial performance improvement over the loudspeaker system described in commonly-owned U.S. Pat. No. 5,887,068 to Givogue et al, Broadly speaking, the exemplary embodiment which showcases the bulbous-tip waveguide transducer of the present invention is a loudspeaker which enhances the sensation of spaciousness while preserving localization and minimizing the sound coloration. Briefly, in accordance with the invention, a bipolar loudspeaker system has identical front-facing and rear-facing bulbous-tip waveguide transducer (i.e., midrange speaker) arrays which are mounted almost back-to-back in an enclosure, such as a tower enclosure, preferably with suitable mid-bass and tweeter drivers and crossover network connections, and connected so that both front and rear facing bulbous-tip waveguide transducer arrays play together to creating a "textbook" bipolar speaker. Such speakers sound better—more spacious and natural—than either front or rear speakers firing alone. Without more, however, even though the measured SPL curves of each of the speakers measured individually may be exemplary and the on-axis SPL may be quite good, the individual front and back SPL curves will be uneven and sound quality will suffer.

This is overcome, in accordance with the invention, by (a) the use of substantially identical front and rear mid-range or mid-bass drivers and tweeters and (b) by reducing the rear sound power (or SPL) that is produced by the rear speaker by about 6 dB with respect to the sound power produced by the front-facing array, while retaining a substantially flat tonal balance for both the front array and rear array, to produce a sound power ratio of about 2:1 as measured by the front and back SPL levels of the speakers. This relationship improves localization for the listener while retaining the spacious envelopment of an improved bipolar sound field. It has been discovered that a range of front-to-back SPL level ratios from about −2 dB to about −10 dB can produce a satisfactory forward focused bipolar array; however, in the preferred embodiment of the invention, a 2:1 (−6 dB) ratio is preferred.

In accordance with the method of the invention, to accurately gauge the bipolar speakers, the front and rear mid-range/tweeter combinations are measured on their own in an anechoic measurement space. The front array of drivers or transducers are measured by first disconnecting the rear-facing midrange and tweeter drivers. To properly load the crossover network connecting the speakers, the rear array crossover wiring is connected to the rear drivers in a separate but identical speaker array placed outside of the anechoic measurement space. Likewise, to measure the rear drivers, the front drivers are disconnected and the crossover the wiring is connected to the front driver array in an identical speaker in a separate room from the anechoic measurement. Taking short-cuts such as trying to pad the rear drivers inevitably results in some leakage that only serves to create confusion. The rear speakers are voiced to measure the same flat tonal balance as the front, except 6 dB lower in level. The crossover points are made as close as possible to the same. Lastly, all drivers in the speaker are connected and measured to check that the tonal balance meets requirements.

The key objectives in the foregoing measurements are to better balance the ratio of direct to reflected sound, and to better balance the spectral content of the reflected sound. The reflected sound field consists of reflections from the off-axis sound field of the front drivers and virtually all of the output of the rear drivers. Except in extremely damped rooms, if the front and rear outputs are the same, the ratio of direct to reflected sound will be somewhat less than 1:1. It has been found that while the reflected sound field may be strong with respect to the direct sound field, there is a limit at which the reflected sound field is so strong that it causes listener confusion and loss of clarity. Likewise, there are lower limits to the level of reflected sound below which the sense of spaciousness will be lost. In accordance with the invention, the desired sound quality is obtained by reducing the output of the rear-facing array, thereby noticeably improving the ratio of direct to reflected sound such that the speaker system's improved bipolar sound field may be characterized as midway between the onset of the effect of spaciousness and the onset of loss of clarity. To this end the SPL output from the rear-facing speaker is set to be ~6 dB below the SPL output of the front-facing speaker under anechoic conditions. This is achieved, in accordance with the invention, by using three substantially identical bulbous-tip waveguide transducers in the system, two in a front-facing array on the front of the speaker enclosure to provide direct sound, and one in a rear facing array on the back of the enclosure to provide reflected sound.

The spectral balance (frequency response) of the reflected sounds at the listener's position in front of the speaker enclosure is largely affected by the acoustical properties of the room boundaries (wall, ceiling, floor). The only way to optimize the speaker spectral balance is to match the rear frequency response to the front. This requires separate crossovers for the front and the back speakers.

The front array and rear array each use the improved midrange driver or bulbous-tip waveguide transducer which provides enhanced linearity. The midrange drivers feature a Balanced Double Surround System ("BDSS" as described in commonly-owned U.S. Pat. No. 7,684,582, incorporated herein) that supports the speaker cone at both the inner and outer edges allowing longer, more linear excursion for greater clarity and finely textured inner detail. The bipolar loudspeaker system of the present invention's bulbous-tip waveguide transducers also include a forwardly-projecting, bulbous waveguide structure which smoothes off-axis frequency response and disperses sound over a wider area and enhances intelligibility for users or listeners when standing or sitting almost anywhere in a room. The enhanced bulbous-tip waveguide transducer of the present invention provides playback of reproduced signals with a more linear response than possible with prior art drivers.

The bipolar loudspeaker system of the present invention includes a front-facing Midrange-Tweeter-Midrange ("MTM") driver array and a rear facing Tweeter-Midrange driver array with substantially identical front-facing and rear-facing bulbous-tip waveguide transducers as the midrange ("M") drivers driven so that the measured SPL curves of each of the arrays (measured individually) are tonally balanced. The front array and rear array have substantially identical on-axis and off axis frequency response and the rear array's output power (SPL) is reduced by, preferably, about 6 dB with respect to the output power produced by the front-facing array, while retaining a flat tonal balance for both the front and rear speakers, to produce a sound power ratio of about 2:1 as measured by comparing the front and back SPL levels of the speakers. This bipolar speaker system and method for voicing was discovered to provide greater clarity and improved localization while retaining the spacious envelopment of the bipolar sound field. A range of front-to-back SPL level ratios from about −2 dB to about −10 dB can produce a satisfactory forward focused bipolar array; however, in the preferred embodiment of the invention, a 2:1 (−6 dB) ratio is used.

It will be understood that although the bulbous-tip waveguide transducer of the present invention is described with respect to the use of bipolar speaker systems within tower-type speaker enclosures, other loudspeaker configurations may be used and such systems may be constructed with or without built-in powered subwoofers.

BRIEF DESCRIPTION OF THE DRAWINGS

The foregoing, and additional objects, features and advantages of the invention will become apparent to those of skill in the art from the following detailed description of preferred embodiments, as illustrated in the accompanying drawings, in which.

DESCRIPTION OF PREFERRED EMBODIMENTS

Figure 15:
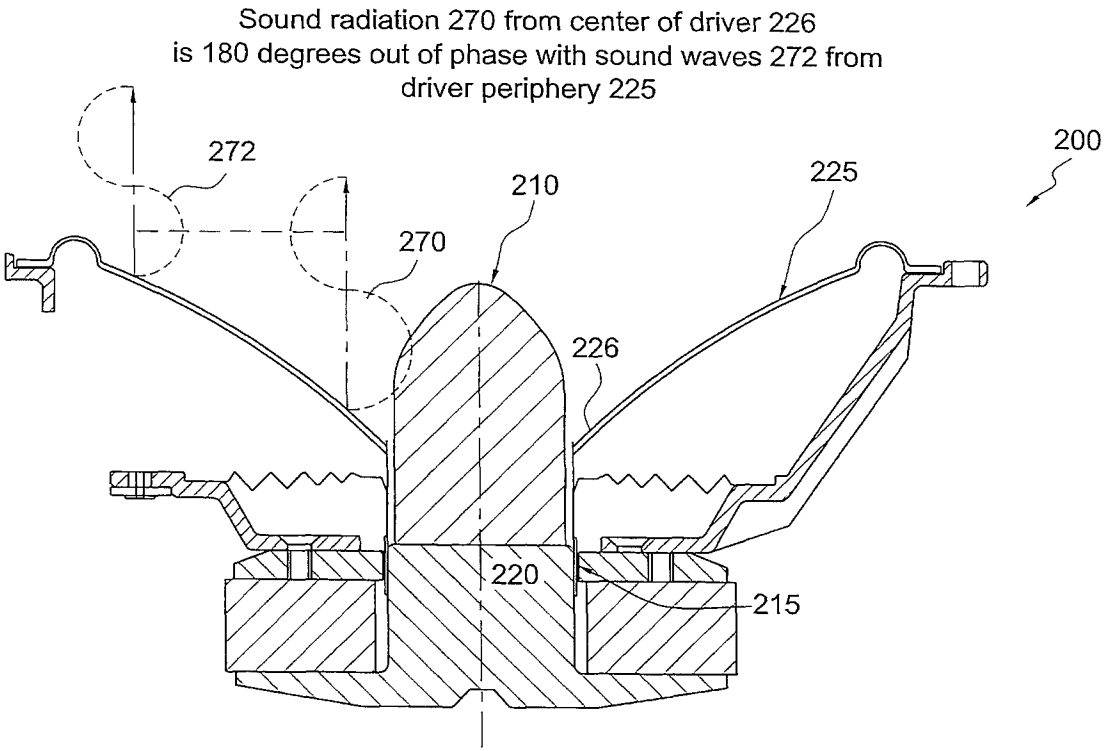
FIG. 15 is a diagrammatic illustration of a prior art woofer incorporating a waveguide.
Figure 16:
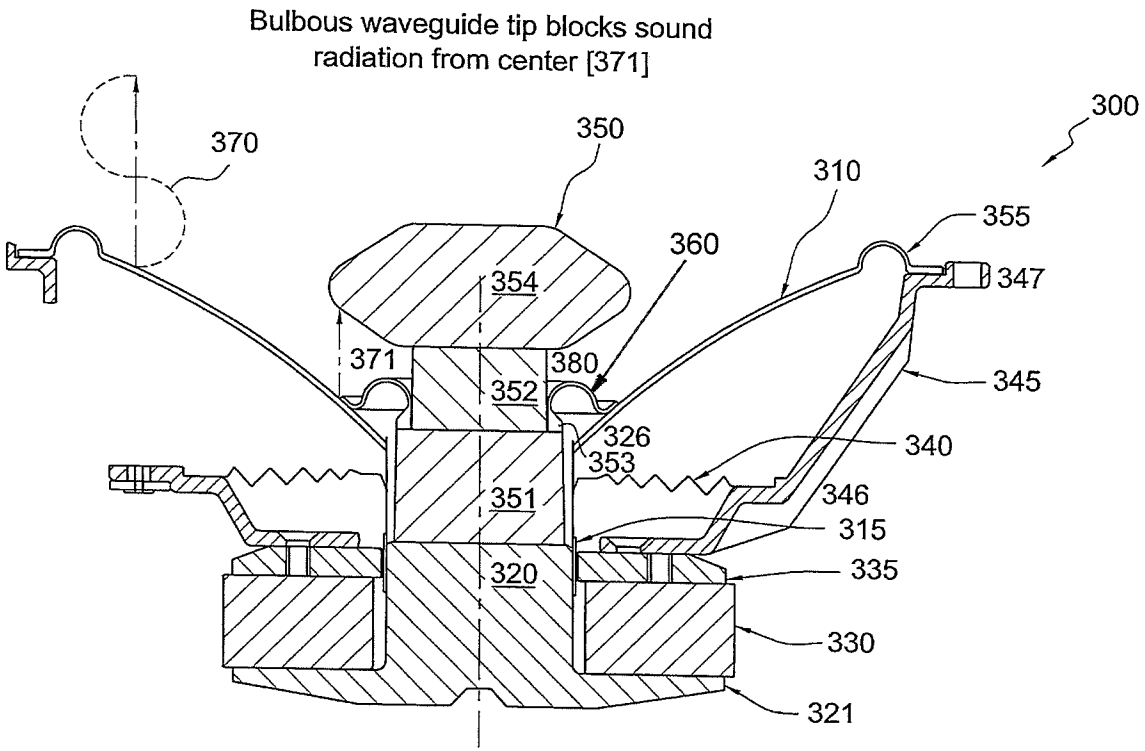
FIG. 16 is a diagrammatic illustration of a woofer incorporating a bulbous waveguide in accordance with the present invention.
Figure 17:
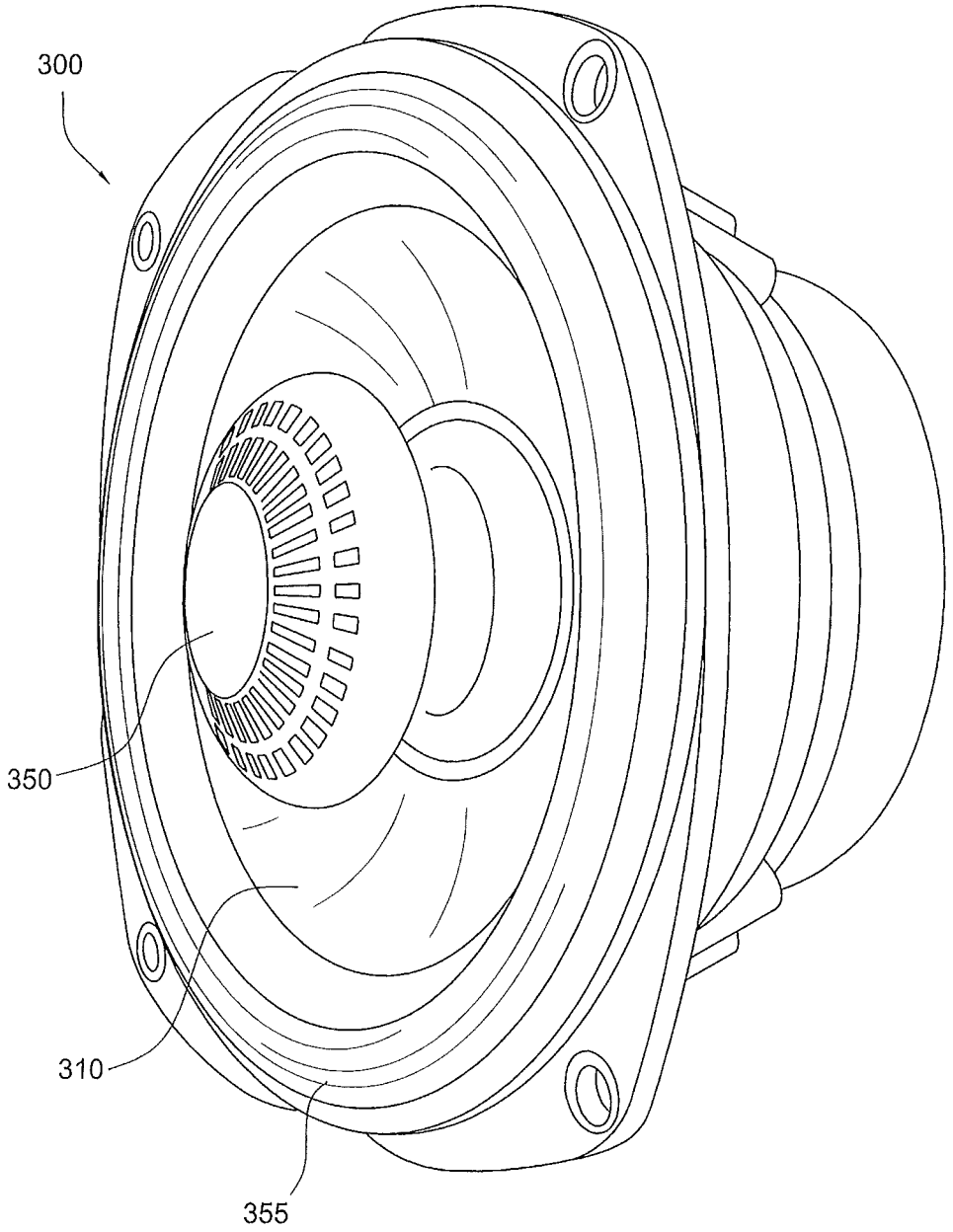
FIG. 17 is a three-dimensional illustration of a woofer incorporating the bulbous waveguide of FIG. 16.

Reference will now be made in detail to one or more embodiments of the invention that are illustrated in the accompanying drawings, FIGS. 1-23, which illustrate an exemplary loudspeaker system (e.g., 22) including a novel electrodynamic acoustic transducer (e.g., 300, as best seen in FIGS. 16 and 17) carrying a bulbous waveguide tip (e.g., 350). The transducer of the present invention is also referred to as the bulbous-tip waveguide transducer (e.g., 350). Same or similar reference numerals may be used in the drawings and the description to refer to the same apparatus elements and method steps. The drawings are in simplified form, not to scale, and omit apparatus elements and method steps that can be added to the described systems and methods, while including certain optional elements and steps. For purposes of convenience and clarity only, directional terms such as top, bottom, left, right, up, down, over, above, below, beneath, upper, lower, rear, and front may be used with respect to the accompanying drawings. These and similar directional terms should not be construed to limit the scope of the invention. Thus, as used herein, "front", "front-facing" and "forward" should be construed to mean a direction which substantially opposes "back, "rear-facing" or "rearward."

Turning now to a more detailed description of the present invention, an exemplary loudspeaker system 20 configured with the bulbous-tip waveguide transducer of the present invention (e.g., 300) is illustrated in FIGS. 1-8 as a bipolar multi-driver loudspeaker system or assembly 22 mounted to project sound from the upper portions of the front and rear walls 24 and 26 of a generally rectangular tower-shaped speaker enclosure 28. As can be seen in FIGS. 1, 2, 4 and 6, tower-shaped speaker enclosure 28 defines a box-shaped enclosure with a first sub-enclosure or chamber for a front-facing driver array 40 and a second sub-enclosure or chamber for a rear-facing driver array 42.

The loudspeaker system 22 in the illustrated embodiment includes an identical pair of front-facing bulbous-tip waveguide transducers (or midrange drivers) 30 and 32 with a tweeter 34 forming front-facing or forward speaker array, and a rear-facing bulbous-tip waveguide transducer (or midrange driver) 36 with a tweeter 38 forming a rear speaker array. The drivers or transducers in the front and rear arrays may be conventionally mounted on suitable baffles in the enclosure 28, it being understood that herein the term "drivers" refers to acoustic transducers or loudspeakers mounted to produce a selected range of output frequencies as is usual and intended for such midrange speakers and tweeters. As illustrated, the front speaker assembly or array is mounted in a front chamber 40 of the enclosure 28, while the rear speaker assembly or array is mounted in a rear chamber 42 of the enclosure, and a volume of enclosed air is disposed there-between comprising part of a Subwoofer system's enclosure volume.

Cabinet or enclosure 28 also includes one or more side-facing woofers such as those illustrated at 50, 52 and 54 in the Figures; these are conventional active drivers and passive radiators and may be mounted via suitable baffles in one or both of the side walls 56 and 58 of the enclosure 28 in known manner.

Figure 9:
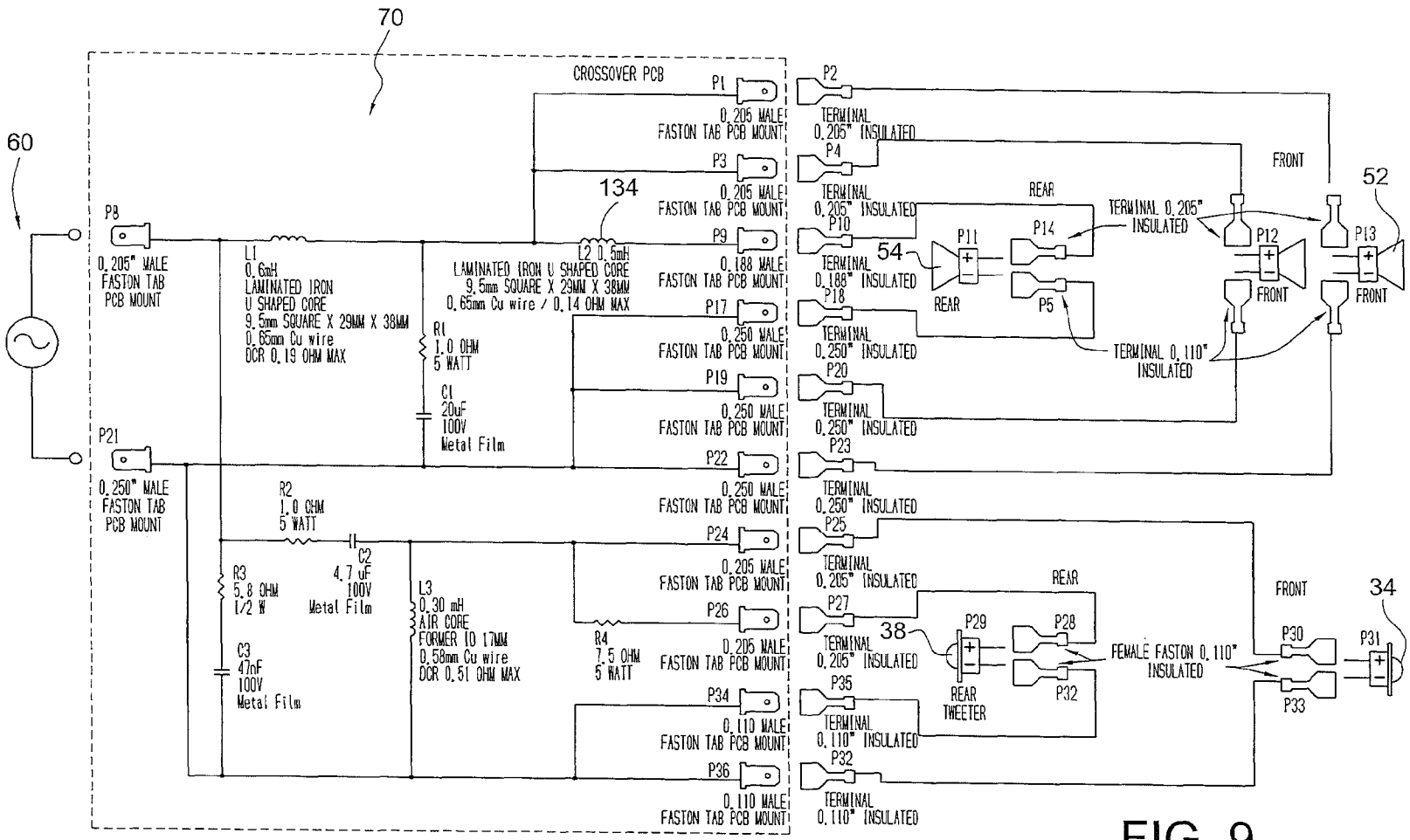
FIG. 9 illustrates is a circuit diagram of a crossover network suitable for the loudspeaker system of the present invention.
Figure 10:
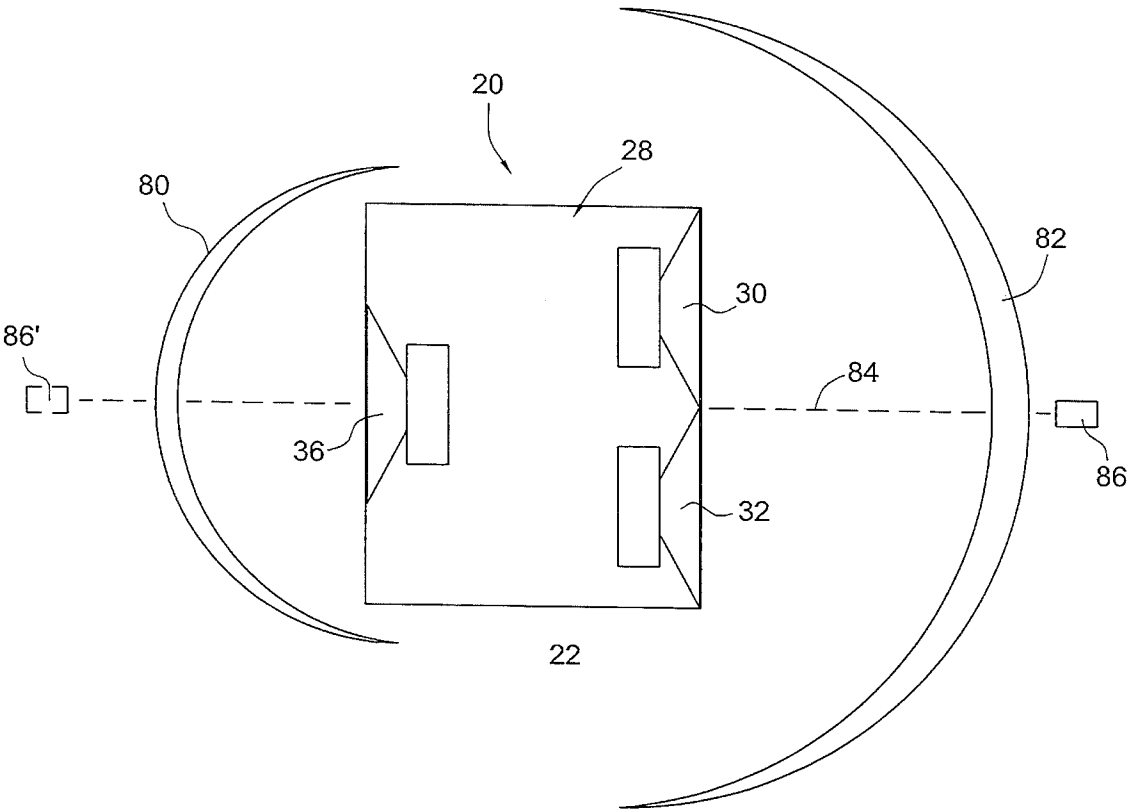
FIG. 10 illustrates diagrammatically the sound pattern produced by the bipolar speaker assembly of the system of FIG. 1.

As illustrated in FIG. 9, the several speakers in the system are connected to be driven by a suitable amplifier or other audio signal input source 60 by way of a crossover network 70. As illustrated, the crossover network is an RLC filter network for limiting the frequencies supplied to the respective drivers (and the driver connection polarities are illustrated). The crossover in the embodiment of FIG. 9 is a standard 2nd order crossover with some small differences. There is a second, smaller value inductor in the midrange 54 circuit. Because the second inductor is about ½ the value of the first, it is not believed to introduce much phase shift. This follows from the desire to match the crossover point and frequency polar plot characteristics. Persons of skill in the art will appreciate that crossover network 70 crossover comprises a passive frequency dividing network configured and tuned to segregate the audio signal into (a) a front-facing array midrange or mid-bass driving signal, (b) a rear-facing array midrange or mid-bass driving signal having substantially the same voltage magnitude as the front-facing array midrange or mid-bass driving signal, (c) a front-facing array tweeter driving signal, and (d) a rear-facing array tweeter driving signal which, compared to said front-facing array tweeter driving signal, is attenuated (see R4) by the "forward focused" power ratio of about one-to-two or 6 dB.

The loudspeaker system of the present invention, as illustrated in FIGS. 1-9, thus comprises a bipolar loudspeaker system wherein substantially identical front-facing and rear-facing midrange drivers are mounted almost back-to-back in an enclosure, such as a tower enclosure, preferably with suitable woofer and tweeter loudspeakers and crossover network connections, and connected so that both the front and rear speaker arrays, when driven from a common audio source, play together to create an improved bipolar speaker sound field. The Bipolar loudspeaker system of the present invention 20 is designed to produce the sound patterns diagrammatically illustrated in FIG. 10. The bipolar sound field of the present invention includes the rearwardly—traveling sound pressure wave 80 and the forwardly—traveling sound pressure wave 82 which surrounds an axis 84 of the speaker assembly 22, and sounds better—more spacious and natural—than either front or rear speaker arrays firing alone. Without more, however, even though the measured SPL curves of each of the speakers measured individually may be exemplary and the on-axis SPL may be quite good, the individual front and back SPL curves will be uneven.

If the individual (front and back array) curves are flat, then the combined (front plus back array) curves will be uneven (which is expected for the embodiments of the present invention as described herein). To make the combined (front plus back array) curves flat requires that the individual curves are uneven (which is what the commonly-owned Givogue patent teaches). The applicants have discovered that, as a practical matter, a reduced rear-array SPL voicing does mitigate the unevenness of the combined front SPL but does not eliminate it. In the end, then one must accept the unevenness of the (front plus back array) combined SPL curve as a measurement artifact. This will be described in greater detail below.

For purposes of the present description, the imaging and tonal balance problems perceived during playback of the prior art designs were overcome, in accordance with the present invention, by reducing the rear sound power that is produced by the rear speaker 36 by about 6 dB with respect to the front sound power produced by the substantially identical front speakers 30 and 32, thereby improving localization while retaining the spacious envelopment of the bipolar sound field. This result is obtained, in the illustrated embodiment, by the use of two forwardly-facing and one rearwardly facing loudspeaker, where the speakers are all substantially identical, and driving the speakers from the same audio source 60.

This arrangement generates twice as much sound from the front-firing array including speakers 30 and 32 than from the rear firing array including speaker 36 to provide the desired 2:1 ratio of output sound power. For the frequency range of greatest interest (mid-range or vocal range) the tonal balance, or frequency response of this system is substantially flat on-axis and well behaved off axis, and because the single midrange driver on the rear baffle is identical to the two midrange drivers on the front baffle, the front and back arrays are substantially timber matched, on and off axis.

To accurately measure the sound output from the bipolar speaker assembly 22, the front and rear midrange/tweeter combinations are measured on their own in an anechoic measurement space by a microphone 86 placed at the axis 84 in front of the speakers. The front drivers 30 and 32 are measured by first disconnecting the rear midrange and tweeter drivers. To properly load the crossover network connecting the speakers, the rear driver crossover wiring is connected to the rear drivers of a separate but identical speaker located outside of the anechoic measurement space. The results of a measurement at microphone 86 of the SPL vs. frequency of the output from the front speakers in a test embodiment of the invention of resulted in the curve 90, illustrated in FIG. 11A. Likewise, to measure the rear driver 36, the front drivers are disconnected and the crossover wiring is connected to the front driver of an identical speaker in a separate room from the anechoic measurement. The results of a measurement, at microphone 86' on the axis 84 at the rear of the speaker assembly 22, of the SPL vs. frequency of the output from the rear speaker in the test embodiment of the invention resulted in the curve 92, also illustrated in FIG. 11A. It is noted that taking short-cuts such as trying to pad the rear drivers instead of disconnecting them inevitably results in some leakage that only serves to create confusion.

Figures 1, 2, 3, 4, 5, 6, 7, 8:
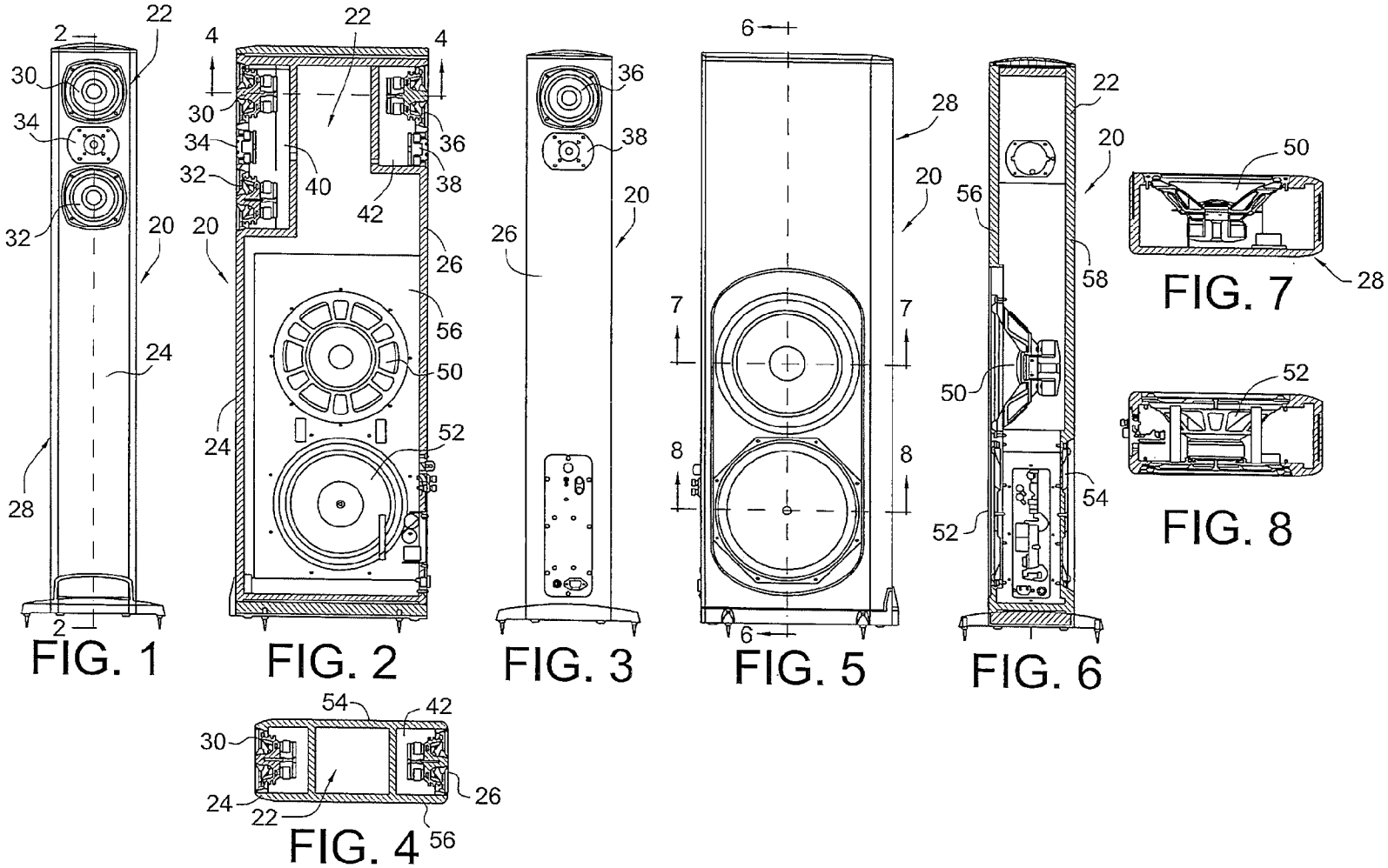
FIG. 1 is a front elevation view of a bipolar loudspeaker system enclosure in accordance with a preferred form of the present invention, illustrating two forward-facing bulbous-tip waveguide transducer (midrange) speakers.
FIG. 2 is a cross-sectional view of the speaker enclosure of FIG. 1, taken along line 2-2 of FIG. 1, illustrating the two forward-facing bulbous-tip waveguide transducers of FIG. 1, a rearward-facing bulbous-tip waveguide transducer, and side-facing woofers.
FIG. 3 is a rear elevation view of the speaker enclosure of FIG. 1.
FIG. 4 is a cross-sectional view taken along line 4-4 of FIG. 2.
FIG. 5 is a side elevation view of the enclosure of FIG. 1, illustrating side-facing woofers.
FIG. 6 is a cross-sectional view taken along line 6-6 of FIG. 5.
FIG. 7 is a cross-sectional view taken along line 7-7 of FIG. 5.
FIG. 8 is a cross-sectional view taken along line 8-8 of FIG. 5.

The rear speaker array was voiced to measure the same flat tonal balance as the front, except 6 dB lower in level. The midrange-tweeter crossover point selected for the rear array 42 and the midrange-tweeter crossover point selected for the front MTM array 40 were made as similar to one another as possible. The output from rear array tweeter 38 is adjusted downwardly from the level of the front tweeter 34 by series resistor R4 (7.5 ohm) in the exemplary embodiment of FIGS. 1-9. During the voicing part of the design process for the embodiment of FIGS. 1-9, all drivers in the speaker system 20 were connected (except for powered subwoofer 50) and measured at microphone 86 on the axis 84 in front of the front array assembly (e.g., as seen in FIG. 1) to check that the tonal balance meets requirements, and this measurement of combined output from both front and rear arrays is illustrated at curve 94 in FIG. 11B.

Figure 11A:
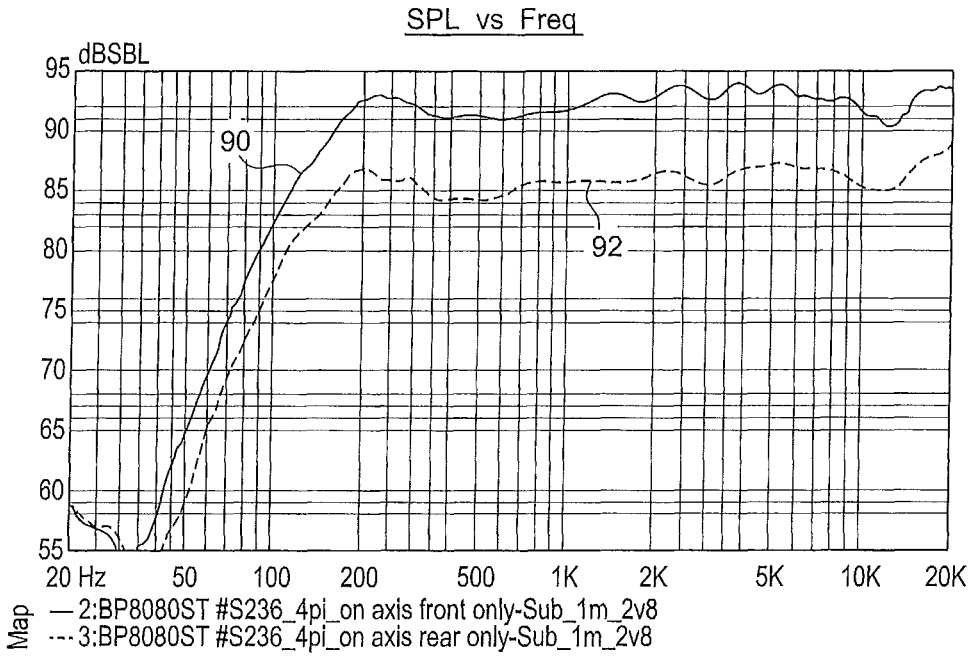
FIGS. 11A and 11B illustrate SPL vs. frequency curves for the system of FIG. 1.
Figure 11B:
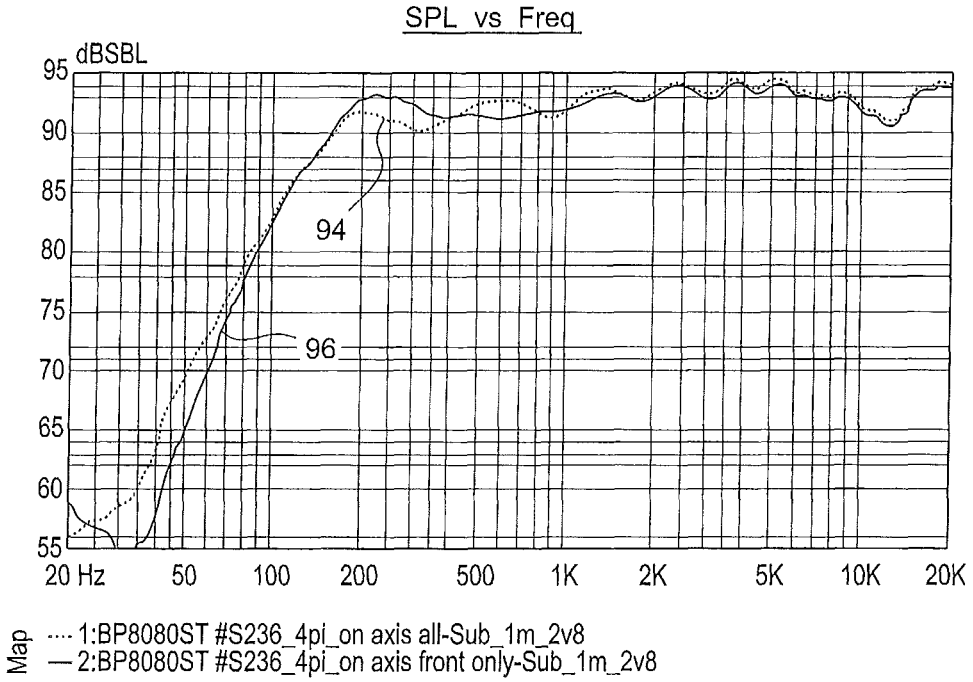

More specifically, curve 94 in FIG. 11B illustrates the measured and plotted observations for SPL as a function of frequency from 20 Hz to 20 kHz for simultaneous operation (front plus back array) of the front array and the rear array, and is included for comparison with the well-behaved nature of the SPL measurements for the front array only (96 in FIG. 11B and curve 90 in FIG. 11A) and the rear array only (curve 92 in FIG. 11A). Curve 96 is a measurement SPL as a function of frequency from 20 Hz to 20 kHz for the front array only, and is included for illustrative comparison with the SPL measurements for the front array and rear array.

Figure 12A:
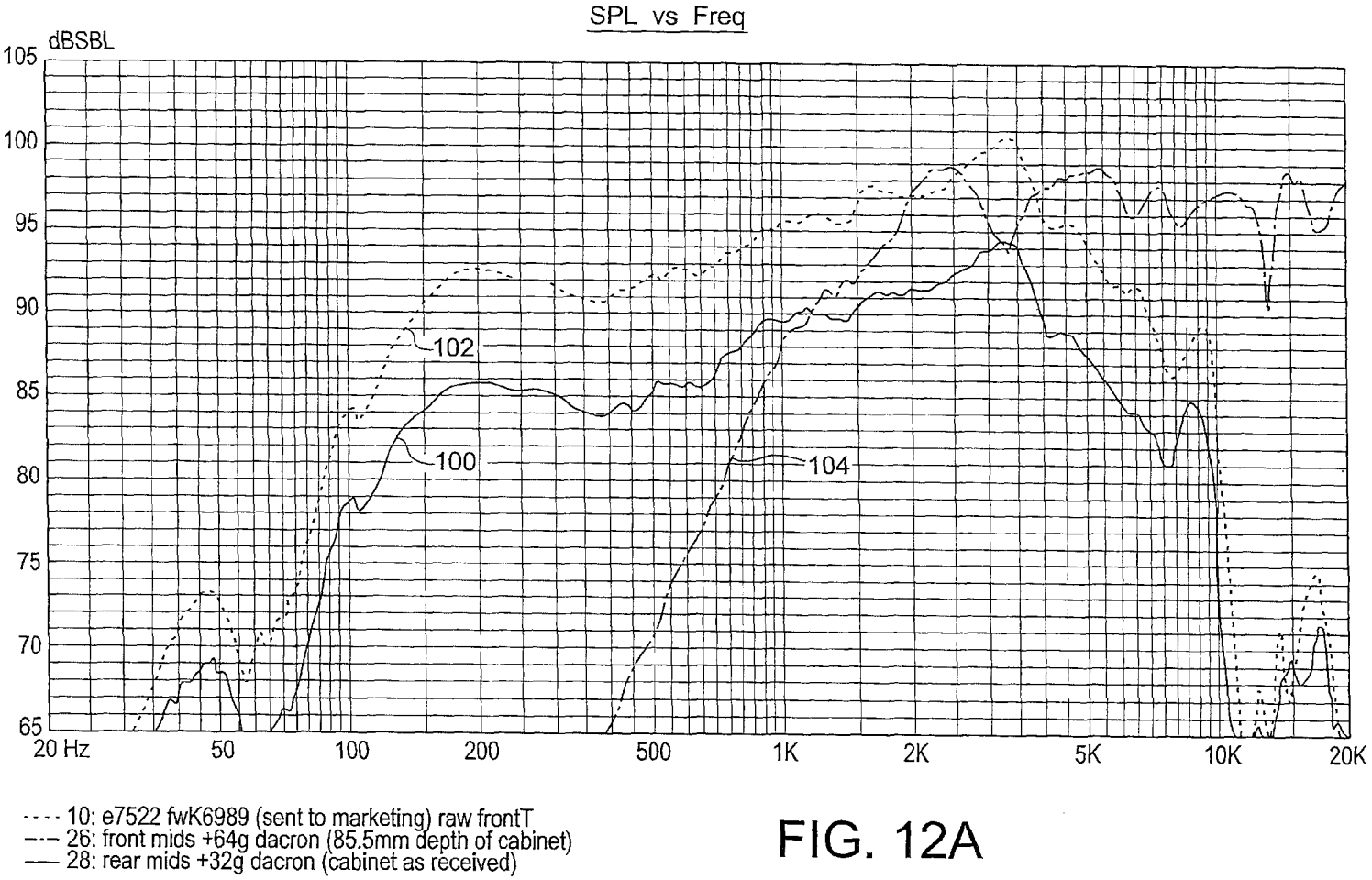
FIGS. 12A to 12C illustrate frequency response data for various speaker combinations in the system of FIG. 1.
Figure 12B:
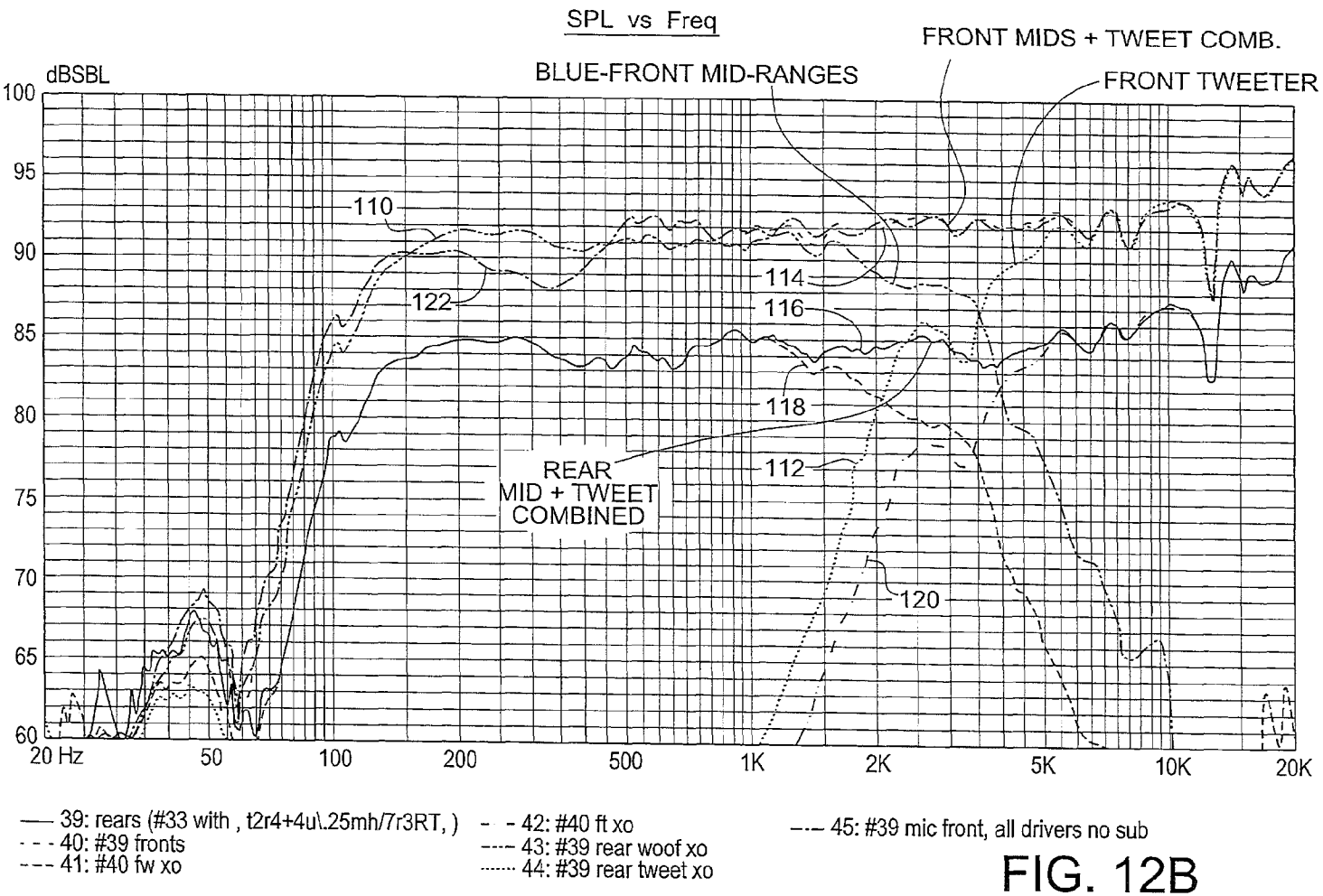
Figure 12C:
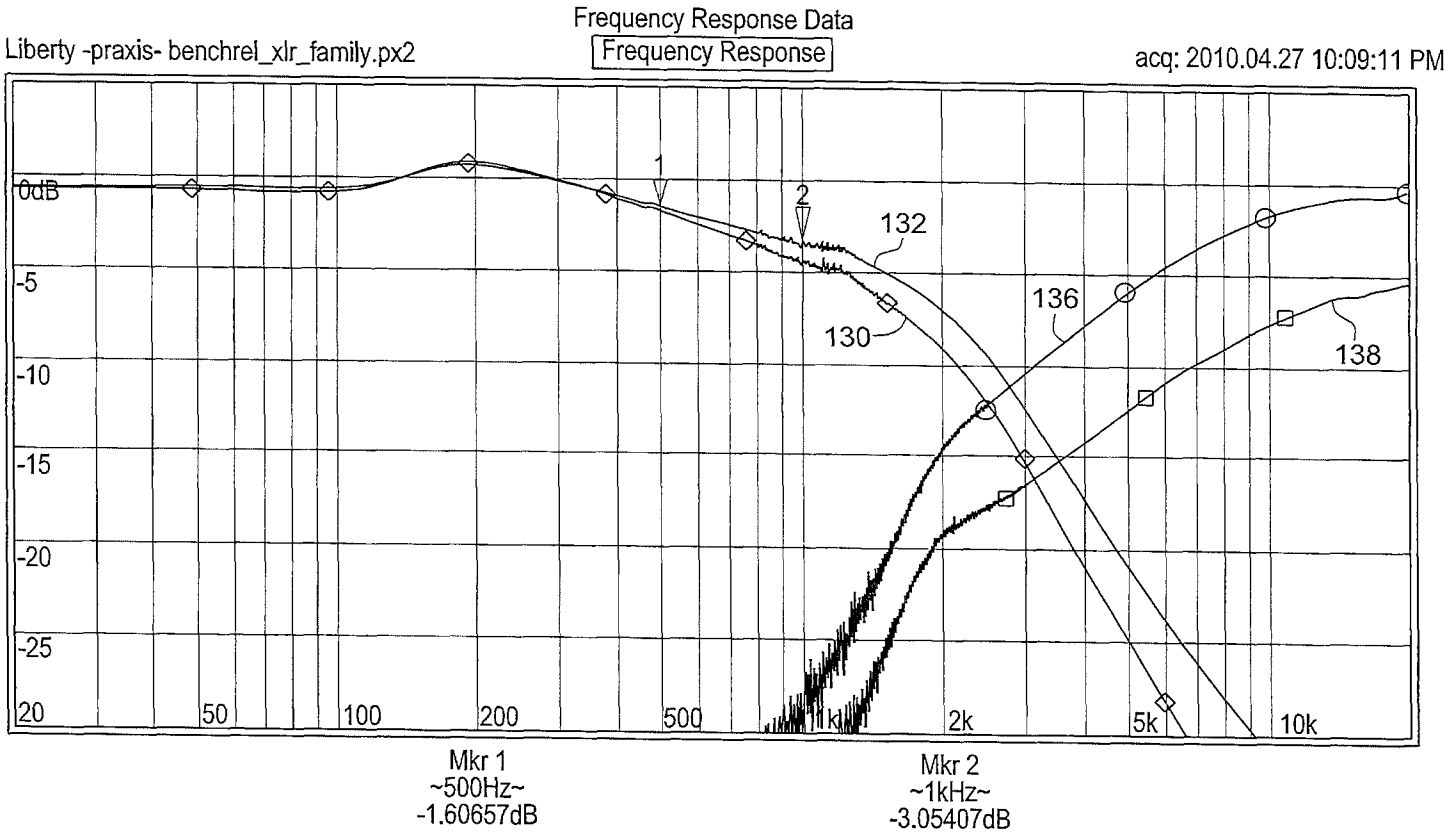

FIGS. 12A and 12B illustrate unadulterated (un-smoothed or raw data) on-axis SPL curves for various cabinet, or enclosure, configurations for the speaker assembly of the invention. As illustrated in FIG. 12A, curve 100 represents the rear midrange SPL, and as shown, it faithfully tracks ~6 dB below the front midrange SPL curve 102. This is the key to the voicing and acoustic design of the present invention. It is also noted that the front midrange drivers 30, 32, as an array, are slightly more vertically directive (or directional) than the rear array because they cooperate to behave as a small vertical line array.

The overall loudspeaker system speaker sensitivity is referenced from or set by the 200 Hz-500 Hz SPL. The crossover (e.g., 70) doesn't add level, except in special and generally undesirable circumstances, instead, the crossover modifies the rest of the frequency response down to match the loudspeaker system's 200-500 Hz level. The output of one tweeter is shown at curve 104; as illustrated, it has plenty of level to be padded down to match the front drivers, and even more to match the back driver. Because there is not much actual power going to the tweeter, a resistive pad in front of the tweeter does not affect overall sensitivity, although it does add extra protection for the tweeter.

Referring now to FIG. 12B, the dashed line 110 shows the SPL vs. frequency curve for the front midrange speakers 30 and 32 measured at the microphone 86, with the crossover network connected to the speakers. The dotted line 112 shows the SPL curve for the front tweeter 34 alone. The curve 114 shows the SPL vs. frequency relationship of the front midrange speakers 30 and 32 and tweeter 34 combined. The line 116 is the SPL curve for the rear midrange speaker 36 and the rear tweeter 38 combined, while the line 118 is the SPL curve for rear midrange speaker 36 alone and the line 120 is the SPL curve for the rear tweeter 38, all measured at the microphone 86 with the crossover network connected. The goal of the crossover network 70 (as illustrated in FIG. 9) is to match all the drivers, with the rear speaker powered 6 dB down from the front speakers. The line 122 indicates the on-axis SPL with front and rear drivers playing. FIGS. 12A and 12B illustrate that there is some interaction between the front and rear drivers at the lower frequencies. This is a natural product of having two speakers aligned in a bipolar array. If the combination curve is "fixed", it can only be done by harming the independent, linear front and back SPL curves.

Even though the rear driver output is 6 dB down from the output of the front drivers, and even if the rear tweeter is padded to reduce its output by 6 dB, it has been found that the crossover point will move up in frequency if the rear speaker is not rolled off. This is illustrated by the crossover network transfer function curves illustrated in FIG. 12C, wherein the curve 130 for the rear driver is shown as being 6 dB down from the curve 132 for the front drivers. Since the rear driver is already 6 dB down, one might expect to need the same transfer function (XFR function), but if this is done, the electrical crossover point will move up from ~2800 Hz to ~3600 Hz because of the tweeter pad. By providing an extra inductor 134 (FIG. 9) in the crossover network, the electrical crossover point comes down to ~3200 Hz. As illustrated by driver SPL curves 110, 112, 117 and 120 (FIG. 12B), the acoustic crossover points are well aligned at ~3500 Hz.

Figure 13:
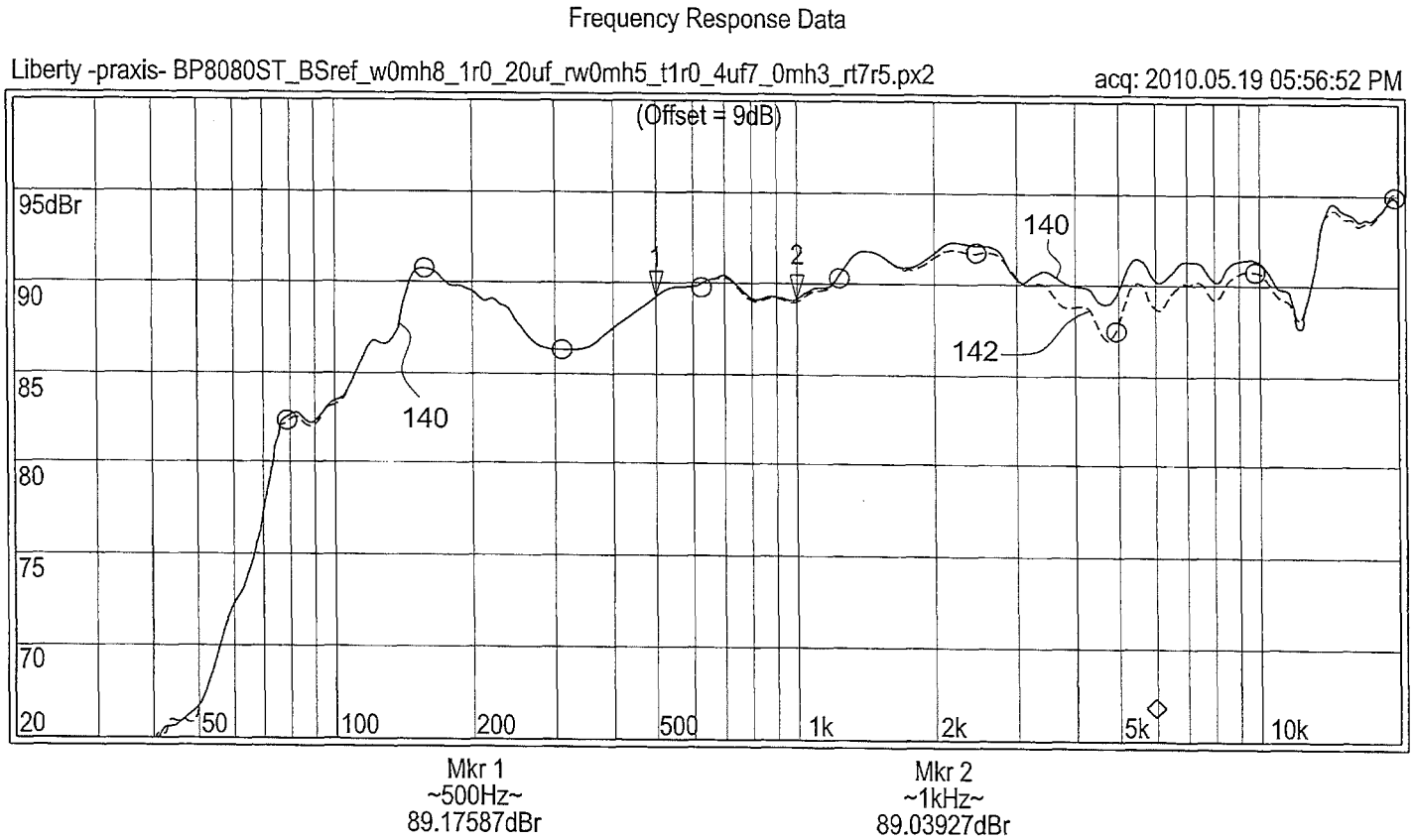
FIG. 13 is frequency response curve illustrating a relatively routine crossover voicing adjustment; the revised crossover was for balance but otherwise has little to do with the bipolar array, and so is included here as illustrative of an exemplary embodiment's performance.
Figure 14:
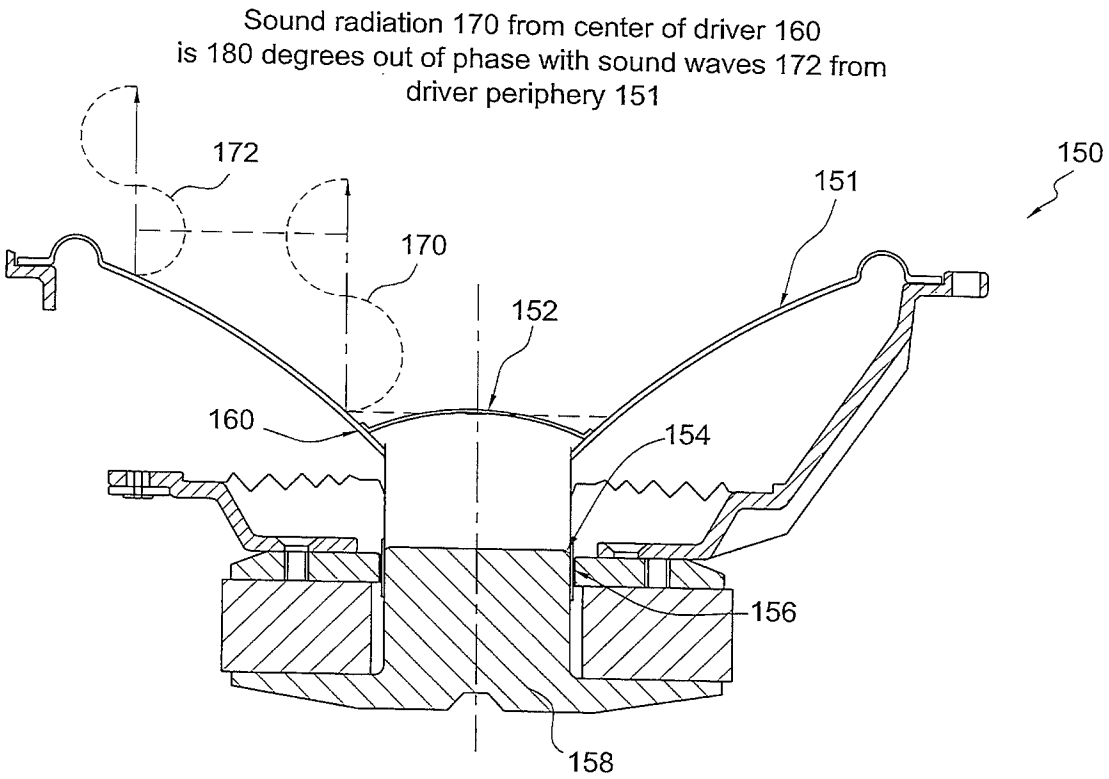
FIG. 14 is a diagrammatic illustration of a prior art woofer.

FIG. 13 illustrates at curves 140 and 142 frequency response data obtained after a frequency balance adjustment in a crossover network for a prototype of the system of the invention to adjust the overall tonal balance of the speaker system. This adjustment produced what one might characterize as a "broad depression" in the treble from 3-10 kHz. The curve 140 shows the adjusted response. These curves are with all drivers playing (but no subwoofer) so they illustrate the characteristic BP ripples. The frequency response curves 140, 142 illustrate a relatively typical crossover voicing adjustment, where the crossover was revised for solely balance. This measurement data has little to do with the bipolar array, per se, but is included here as illustrative of an exemplary embodiment's performance.

In summary, the objectives of the present invention are achieved by providing a bipolar loudspeaker system having a front array and a rear array with substantially identical midrange drivers and by reducing the sound power that is produced by the rear array by about 6 dB with respect to the sound power produced by the front-facing array, while retaining a substantially flat tonal balance for both the front and rear speakers. This 6 dB reduction of the rear sound power, which is a sound power ratio of about 2:1 as measured by the front and back SPL levels of the speakers, is conveniently provided, in accordance with one aspect of the invention, by the use of two forward-facing midrange drivers 30, 32 and one rearwardly-facing driver 36, with all three midrange drivers being substantially identical. This relationship improves the listener's sense of localization while retaining the spacious envelopment of the bipolar sound field. It has been discovered that a range of front-to-back SPL level ratios from about −2 dB to about −10 dB (i.e., ratios of 3:1 (9.5 dB), 4:3 (2.5 dB), 5:2 (8 dB), etc.) can produce a satisfactory forward focused bipolar listening experience; however, in the preferred embodiment of the invention, a 2:1 (−6 dB) ratio is used. In accordance with the present invention, the on-axis SPL curve, as obtained in an anechoic chamber, for the entire speaker is not of concern; instead, the design emphasis is on making each of the front array and rear array SPL curves as flat and as tonally identical as possible, on axis and off axis, except for their level.

In another aspect of the present invention, the loudspeakers used in the system described above may be constructed as acoustic transducers with bulbous waveguide tips. Acoustic transducers with forwardly projecting waveguide members are known, as discussed in the above-referenced commonly owned U.S. Pat. No. 7,684,582 which has been incorporated herein by reference. As there pointed out, high quality prior art electro-acoustic cone diaphragm transducers, such as those illustrated at 150 in FIG. 14, have deficiencies in their high frequency performance, for at high frequencies destructive interference due to the depth of the cone diaphragm causes irregularities in the frequency response. The transducer 150 includes a diaphragm 151 and a dustcap 152 which effectively seals air leaks through a gap 154 between a voice coil 156 and pole piece 158 and which also provides a resistive termination of the center portion 160 of diaphragm 151, dampening unwanted reflections. This, however, is not a solution to the high frequency distortions caused by destructive interference. High frequency sound waves 170 from the center portion 160 of the diaphragm 151 and from the dust cap 152 are 180 degrees out of phase with high frequency sound waves 172 emanating from the periphery of the diaphragm 151. The dustcap 152 makes up a substantial percentage of the total transducer radiating are and, therefore, makes a substantial contribution to high frequency interference and distortion in the transducer 150.

A waveguide may be used to fill the cavity and reduce the high frequency irregularities from the destructive interference, but prior art waveguides do not prevent destructive interference from the central section of the diaphragm. One such waveguide extension structure is illustrated in FIG. 15, which shows an electrodynamic acoustic transducer 200. The transducer 200 is similar to the transducer 150 of FIG. 14, but without a dustcap. Instead, a waveguide extension structure 210 that is tapered towards the front of the transducer with a bullet shaped or cone shaped tip is disposed within the cavity formed by a voice coil 215, pole piece 220, and diaphragm 225. The waveguide extension structure 210 fills this cavity and reduces the high frequency distortions that result from the destructive interferences. Unfortunately, the waveguide extension structure 210 does not prevent destructive interference from sound waves 270 emanating from the central area of the diaphragm 226 with sound waves 272 emanating from the periphery of the diaphragm 225.

Thus, known electrodynamic acoustic transducers suffer from one or more of the deficiencies described above, and it is desirable to provide an approach for improving transducer response at high frequencies by reducing destructive interference between high frequency sound waves from the center of the diaphragm and high frequency sound waves emanating from the periphery of the diaphragm. This is accomplished in accordance with this aspect of the invention, by providing a bulbous tip to the front of the waveguide extension to increase efficiency and decrease audio distortions of the transducer as compared to prior art waveguides.

In conventional loudspeakers, efficiency requires a diaphragm which is both strong and light weight. Strength and light weight is typically achieved using a truncated cone shaped diaphragm with the minor diameter of the cone inside the transducer and the major diameter (flare or mouth) of the cone pointed out towards the front of the transducer. The cone shaped diaphragm may have straight or curved sides. The depth of the cone is such that at high frequencies the center of the cone may be ½ wavelength of sound deeper than the cone periphery, thereby causing the destructive interference described above. The destructive interference is frequency dependent, resulting in uneven frequency response, reduced efficiency, and audible distortion of the sound.

FIG. 16 illustrates in cross-section an electrodynamic acoustic transducer 300 in accordance with the presently-described aspect of the present invention. The transducer 300 includes a diaphragm 310 attached at the periphery of its center opening to a voice coil 315, so that movement of the voice coil 315 translates into movement of the diaphragm 310. The voice coil 315 is disposed on and is capable of moving along a cylindrical pole piece 320. A small gap exists between the voice coil 315 and the pole piece 320. In the illustrated embodiment, the pole piece 320 is integrated with a back plate (or base) 321. Permanent magnet 330 provides the static magnetic field in which the voice coil 315 moves. The magnet 330 is a substantially annular device with a central opening of sufficient diameter to accommodate the pole piece 320.

A front plate 335 is disposed on the magnet 330, so that the magnet 330 is located between the back plate 321 and the front plate 335. The front plate 335 is also substantially annular in shape with a central opening of sufficient diameter to accommodate the pole piece 320. In the illustrated embodiment, the central opening of the front plate 335 is slightly smaller than the central opening of the magnet 330, so that the gap between the front plate 335 and the pole piece 320 is smaller than the gap between the magnet 330 and the pole piece 320. The front plate 335 may be made from a magnetic material, i.e., material with high magnetic permeability, such as iron, certain other metals, and alloys of iron and/or other metals. This list is not exclusive. The pole piece 320 may also be made from magnetic material, for example, the same material as the front plate 335. Thus, the flux of the static magnetic field emanated by the magnet 330 is focused (concentrated) in the gap between the front plate 335 and the pole piece 320. The voice coil 315, and particularly the portion of the voice coil 315 with the wire windings, can move along the pole piece 320 in the gap between the front plate 335 and the pole piece 320. The voice coil 315 moves out (up) and in (down, as the directions appear in FIG. 16) under influence of Lorentz electromotive forces created by the interaction of the static magnetic field within the gap and the variable current flowing through the windings of the voice coil 315. The movement of the voice coil 315 is transferred in a substantially linear manner to the diaphragm 310 through the diaphragm's neck area 326, which is attached to the former of the voice coil 315. Movement of the diaphragm 310 generates and radiates sound waves in response to the variations in the current driving the wire windings of the voice coil 315. Resonances of the diaphragm 310 are terminated or reflected at the neck area 326.

In addition to the flared conical shape of the diaphragm 310 illustrated in FIG. 16, the diaphragm may assume various other shapes. In some embodiments, for example, the diaphragm 310 is an exponential flare or has a straight-sided conical shape. The diaphragm 310 may be made from various materials, as desired for specific performance characteristics and cost tradeoffs of the transducer 300. In some embodiments, for example, the diaphragm 310 is made from paper, composite materials, plastic, aluminum, and combinations of these and other materials (this list is not all-inclusive).

An annular spider 340 is attached at its outer periphery to a middle portion 346 of a frame 345. The inner periphery of the spider 340 is attached to the upper end of the voice coil 315, below the diaphragm 310. In this way, the spider 340 provides elastic support for the voice coil 315, aligning and centering the voice coil 315 on the pole piece 320 in both radial and axial directions. The spider 340 may be made from flexible material that can hold the voice coil 315 in place when the voice coil 315 is not driven by an electric current, and also allow the voice coil 315 to move up and down under influence of the electromotive force when the voice coil 315 is driven by an electric current. In some embodiments, the spider 340 is made from multi-layered fabric. Other suitable materials may also be used.

The frame 345, otherwise known as a "chassis" or "basket," is used for attaching various components of the transducer 300, including the spider 340. The frame 345 also supports the transducer 300 for mounting in a baffle. It may be made from metal or another material with sufficient structural rigidity. In the transducer 300, the frame 345 and front plate 335 are held together with bolts, while the front plate 335 and back plate 321 are attached to the magnet 330 with glue, e.g., epoxy. In some alternative embodiments, all these components are attached with glue or with one or more bolts. Other suitable attachment methods and combinations of methods may also be used for attaching these components to each other. An outer roll seal 355 connects the outer periphery of the diaphragm 310 to an upper lip 347 of the frame 345. The outer roll seal 355 is flexible to allow limited movement of the outer periphery of the diaphragm 310 relative to the frame 345. The dimensions of the outer seal 355 are such that it allows sufficient movement to accommodate the designed peak-to-peak excursion of the diaphragm 310 and the voice coil 315. In cross-section, the outer seal 355 may be arch-like, for example, semi-circular, as is shown in FIG. 16. It should be noted, however, that the invention is not necessarily limited to transducers with outer seals having arch-like cross-sections, but may include transducers with sinusoidal-like and other outer seal cross-sections. The material of the outer seal 355 may be chosen to terminate unwanted resonances in the diaphragm 310. The outer seal 355 may be made, for example, from flexible plastic, e.g., elastometric material, multi-layered fabric, impregnated fabric, or another material.

A distally or outwardly projecting waveguide extension structure 350 is attached to the upper end (as it appears in FIG. 16) of the pole piece 320 so as to fill a substantial portion of a cavity 380 defined by the volume swept by projecting the pole piece 320 upwardly to intersect the plane defined by the outer periphery of the diaphragm 310 when the voice coil 315 is at rest. By filling the cavity 380, the waveguide extension structure 350 reduces distortions in the audio response of the transducer 300.

The shape of the waveguide extension structure 350 may be such that the structure 350 clears the moving parts of the transducer 300; minimizes (reduces) diffraction of sound energy; extends forward approximately to the plane defined by the outer periphery of the diaphragm 310 when the voice coil 315 is at rest; and extends radially outward above the central radiating area of the cone so as to obscure the center portion of the diaphragm. In the embodiment illustrated in FIGS. 16 and 17, the waveguide extension structure 350 includes a first coaxially aligned portion 351 of a first diameter, a second coaxially aligned portion 352 of a second diameter, and a third coaxially aligned, radially projecting larger diameter bulbous tip 354. The second diameter is slightly smaller than the first diameter, so that a coaxial annular ledge 353 is formed at the interface of the two portions. The first, second or third diameters may be larger than the diameter of the coaxial pole piece 320. Other shapes of the waveguide extension structure 350 also fall within the subject matter of the present invention. The waveguide extension structure 350 may be solid or hollow, and if desired may be made integral with the pole piece 320, that is, made as part of the pole piece 320. In this embodiment, the bulbous tip 354 has a larger diameter than the pole so that it partially obscures direct sound emanating from the center radiating area of diaphragm 310. The waveguide's distal bulbous tip 354 may be made of any appropriate acoustically damped material and with any profile or shape, solid or hollow, smooth or rough, soft or hard, continuous or discontinuous surface as required to prevent short wavelength sound 371 from the center of the diaphragm 325 from destructively interfering with short wavelength sound 370 from the periphery of the diaphragm 325.

In some embodiments of the transducer 300, an optional inner flexible roll seal 360 may provide a compliant connection between the diaphragm 310 and the waveguide extension structure 350, to prevent air leakage through the gap between the pole piece 320 and the voice coil 315. In other words, the inner seal 360 isolates the air in front of the diaphragm 310 from the air behind it. To perform this function, the inner seal 360 may be made, for example, from non-porous material. In some embodiments, the inner seal 360 includes a rigid section where it attaches to the waveguide extension structure 350, ensuring solid attachment between these components. As shown in FIG. 16, the area of attachment of the inner seal 360 to the waveguide extension structure 350 is generally along the ledge 353. FIG. 17 is a three-dimensional rendition illustrating the new BDSS loudspeaker 300, showing an embodiment of a bulbous waveguide 350, such as that diagrammatically illustrated in FIG. 16.

Figure 18:
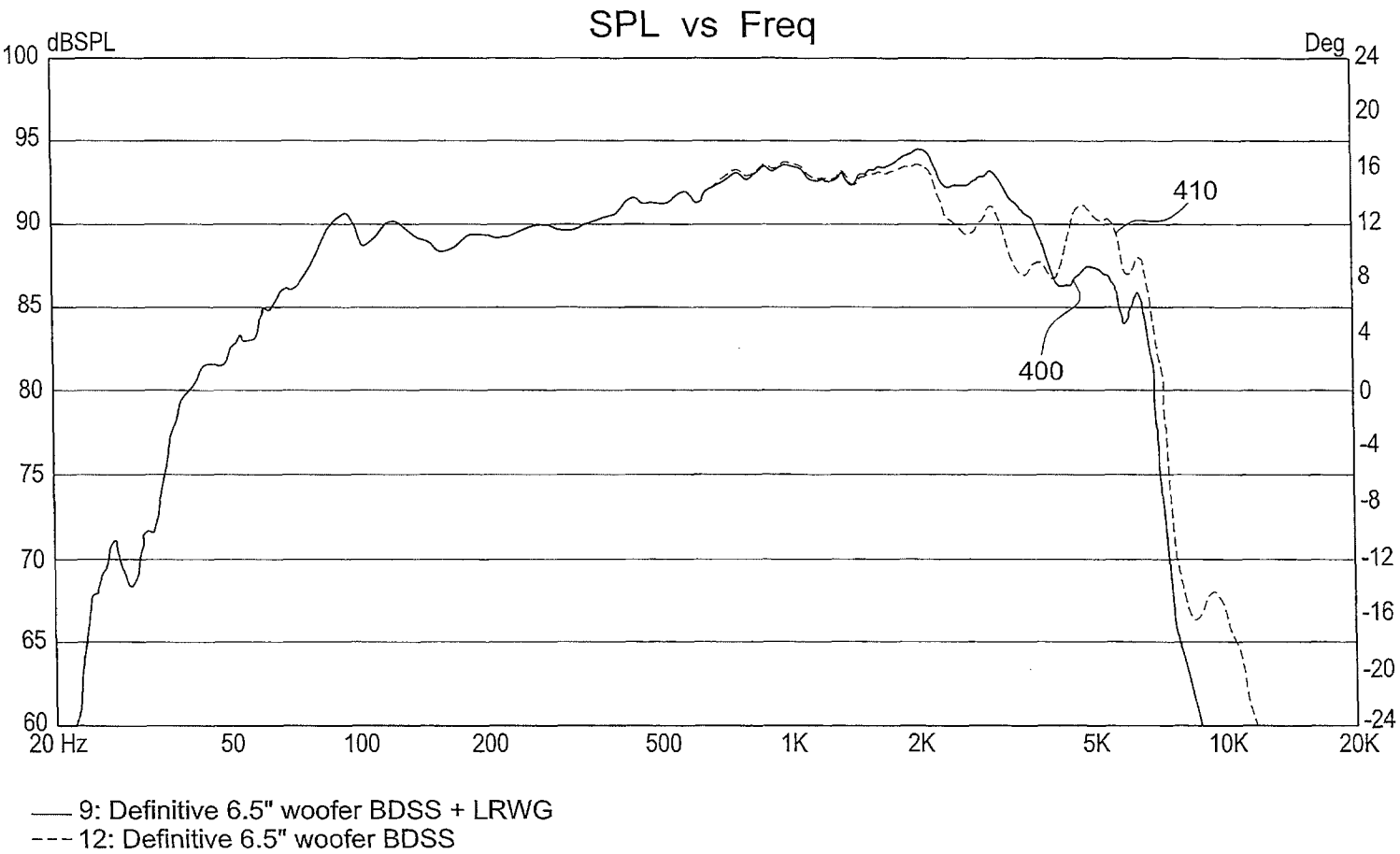
FIGS. 18-20 are graphical illustrations of the SPL vs. frequency characteristics of the woofer of FIG. 16.
Figure 19:
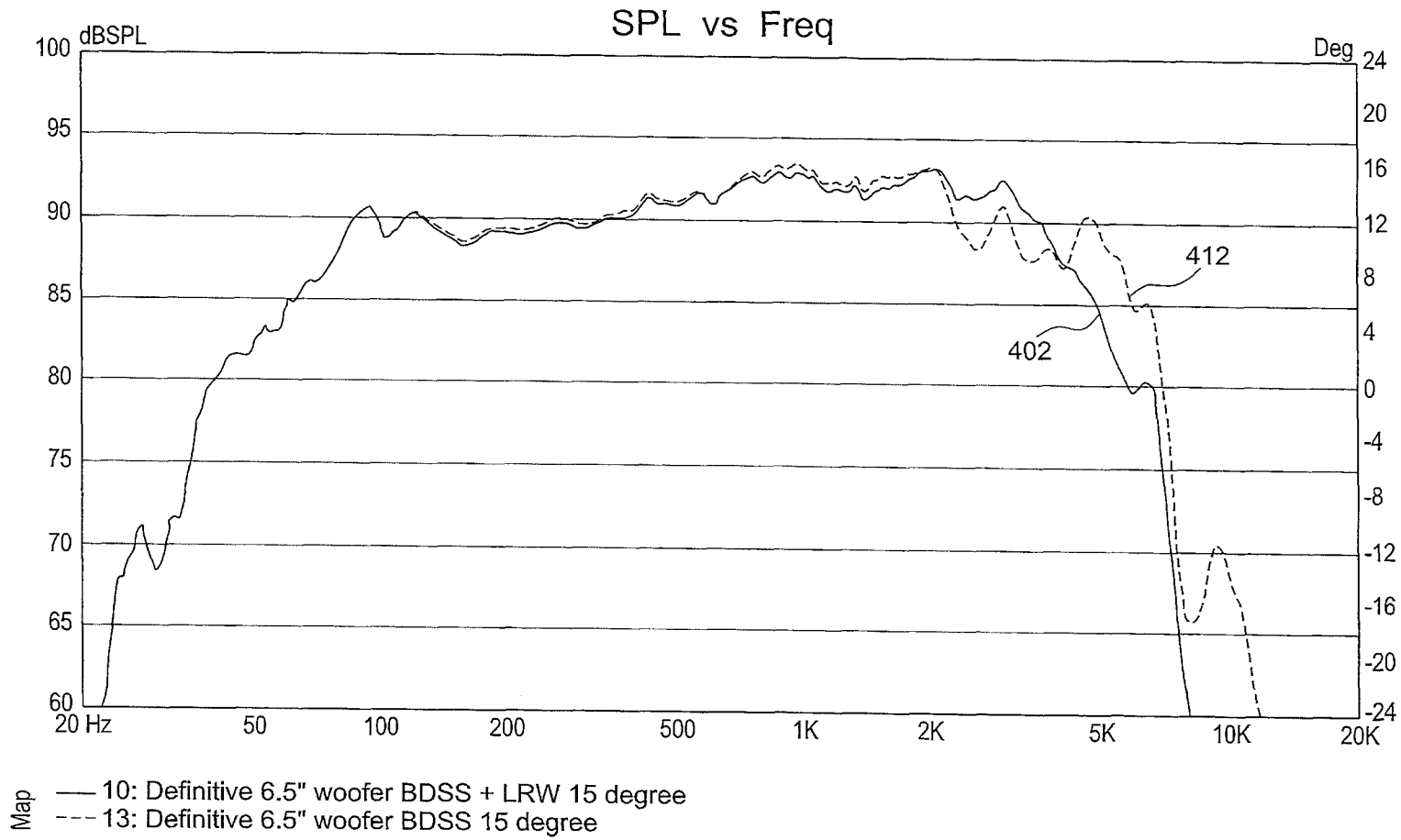
Figure 20:
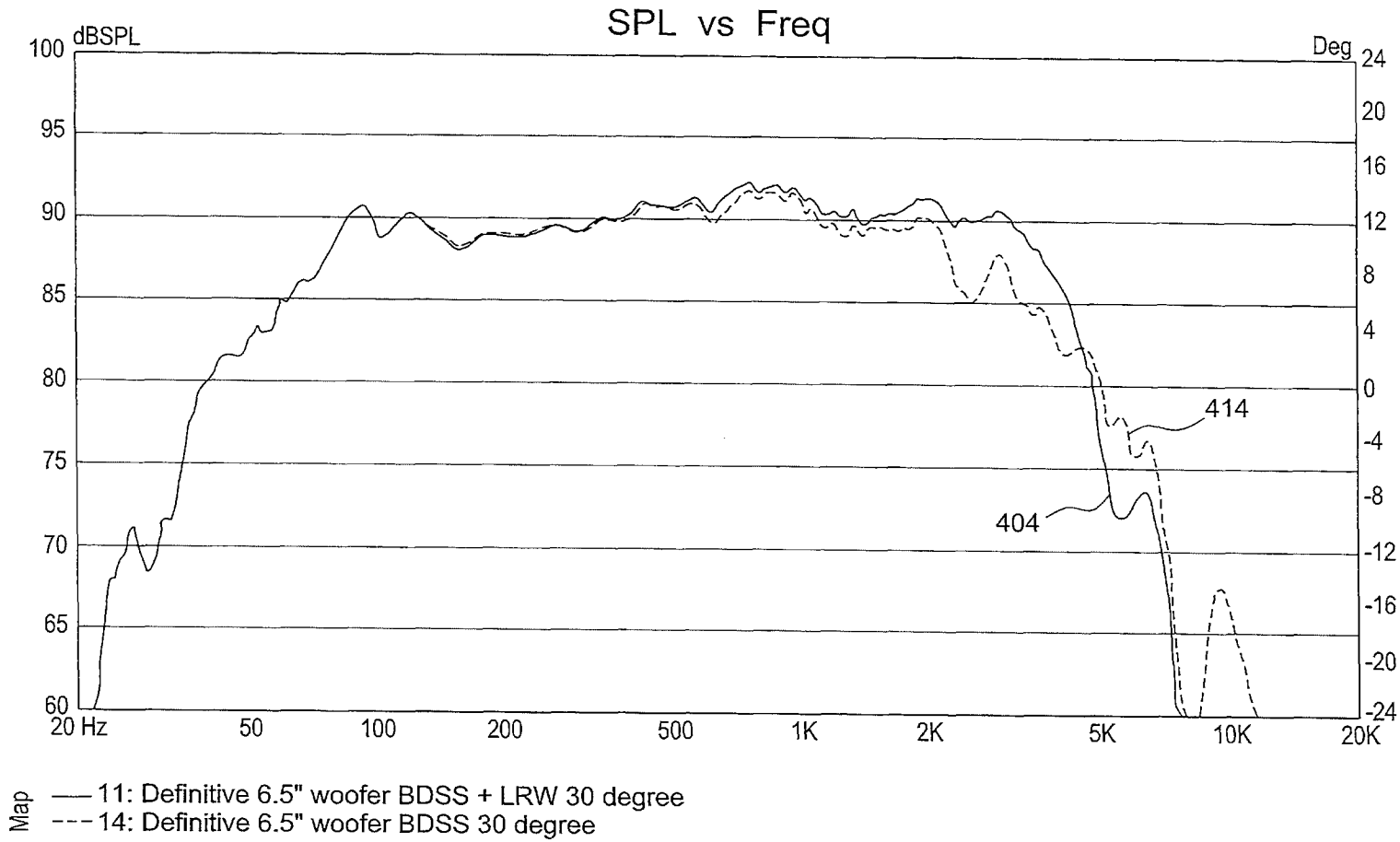

FIGS. 18, 19 and 20 illustrate the on axis, 15 degree and 30 degree SPL curves, respectively comparing a linear response BDSS midrange or mid-bass driver or speaker 300 having the waveguide bulbous tip 350, illustrated at curve 400, 402 and 404 in the respective Figures with the prior art waveguide 210 of FIG. 15, shown by curves 410, 412, and 414, in the respective Figures. When comparing the responses illustrated for all three measuring positions, it can be seen that the tip 350 extends the useful frequency response by ~⅔ octave in the crucial crossover frequency band (2 kHz-4 kHz). The frequency extension with the tip is smoother and with steeper roll-off than without the tip, which makes well-behaved crossover design more straightforward.

It will be appreciated that the improved bipolar loudspeaker system 20 of the present invention represents a substantial performance improvement over the loudspeaker system described in commonly-owned U.S. Pat. No. 5,887,068 to Givogue et al. The improved performance arises from two important developments. First, as noted above, the applicants discovered that the front array SPL level is optimally balanced at roughly 6 dB higher than the rear-array's SPL level, while maintaining flat tonal balance for the front and flat tonal balance for the rear. Applicant's prototypes have been tested and a broader range (of front to back SPL level) with the rear anywhere from −2 dB to −10 dB below the front level provides a significant improvement over the prior art. This first development is believed to be the central characteristic of the "forward focused" bipolar assembly 22. Secondly and less importantly, the applicants discovered that achieve this improved performance was rendered easier by using substantially identical drivers 30, 32 and 36 with a selected ratio of drivers, front to back. In the preferred embodiment applicants chose to use a 2:1 (6 dB) ratio, but acceptable levels of improvement are also observable with other ratios (e.g., 3:1 (9.5 dB), 4:3 (2.5 dB) or 5:2 (8 dB), etc), where the SPL level from the front array is always larger than the SPL from the rear array.

The Bipolar loudspeaker system of the present invention 20 is "voiced" by selecting loudspeaker driver characteristics and crossover circuit topologies to achieve a very different design objective than the (commonly owned '068) Givogue patent's design objective. The Givogue patent teaches methods to build a bipolar speaker that will produce a measured smooth, flat, on-axis, anechoic SPL curve for the entire speaker when front and rear arrays are driven together. By way of contrast, the Bipolar loudspeaker system of the present invention teaches away from that design goal, and instead substantially ignores the on-axis, anechoic SPL curve for the entire speaker 94. Instead, the speaker system of the present invention 20 is voiced to make the front-array curve 90 and back-array curve 92 each as flat and as tonally identical as possible (except for power level or SPL), preferably on axis and off axis. The techniques needed to realize a speaker meeting the objectives of the Givogue patent are not optimal for achieving the overall sound quality goals met by the Bipolar loudspeaker system of the present invention 20. A few specific design differences flow from this new approach. First, the side firing driver is spurious. Specifically, the artifacts (in the measured curve) that the Givogue patent attempts to improve are too high in frequency for the side firing speaker (e.g., subwoofer 50) to reproduce without introducing distortion of its own. In all practical applications the side firing driver is low-pass-filtered below the midrange (e.g., less than or below 200 Hz) which is where all the spatial effects really begin to work and where the ripples appear in the measured SPL.

Second, the Givogue patent teaches use of independent frequency dividing crossover networks for the front and back drivers specifically to flatten the anechoic on-axis frequency response, with no regard to the individual arrays' front and back frequency response and tonal balance. In practice, this leads to speakers with a rear-array tonal balance which is quite different from the front-array tonal balance. The rear SPL of a speaker conforming to the Givogue method is typically deficient in the lower midrange which makes the perception that such a speaker sounds harsh and lacks clarity. The Bipolar loudspeaker system 20 and crossover 70 are instead intended to make the front and back speaker arrays each be tonally balanced individually, which leads to a more pleasant sounding loudspeaker system that retains beneficial spatial effects of a Bipolar configuration. Persons of skill in the art will therefore appreciate that the Bipolar loudspeaker system of the present invention isn't an extension of the Givogue patent teachings, but instead follows a quite different set of design goals.

The loudspeaker system 20 and method of the present invention delivers high definition mid and high frequency sound reproduction. The front-facing array is preferably a D'Appolito-style M-T-M array preferably of two cast-basket 5¼" second generation BDSS midrange drivers 30, 32 surrounding a 1" aluminum dome tweeter 34 housed in an acoustically isolated sealed enclosure 40. The midrange drivers are preferably improved Balanced double Surround System ("BOSS") midranges which include compliant supports for the midrange speaker cone at both the inner and outer edges allowing longer, more linear excursion for greater clarity and finely textured inner detail. The midrange drivers 30, 32, and 36 also preferably include a new Linear Response Waveguide structure 350 configured to smooth off-axis frequency response and disperse sound over a wider area for clear intelligibility. Each tweeter 34, 36 is preferably an aluminum dome driver which has been heat-treated to relax the crystal structure and then coated with a ceramic. The rear-facing driver array uses a single identical BDSS driver and the same 1" aluminum dome tweeter as used in the front-facing M-T-M array. Like the front array, the rear array is housed in a separately sealed MDF enclosure 42 to isolate the midrange drivers from the sub-woofers' influence.

Figures 21, 22, 23:
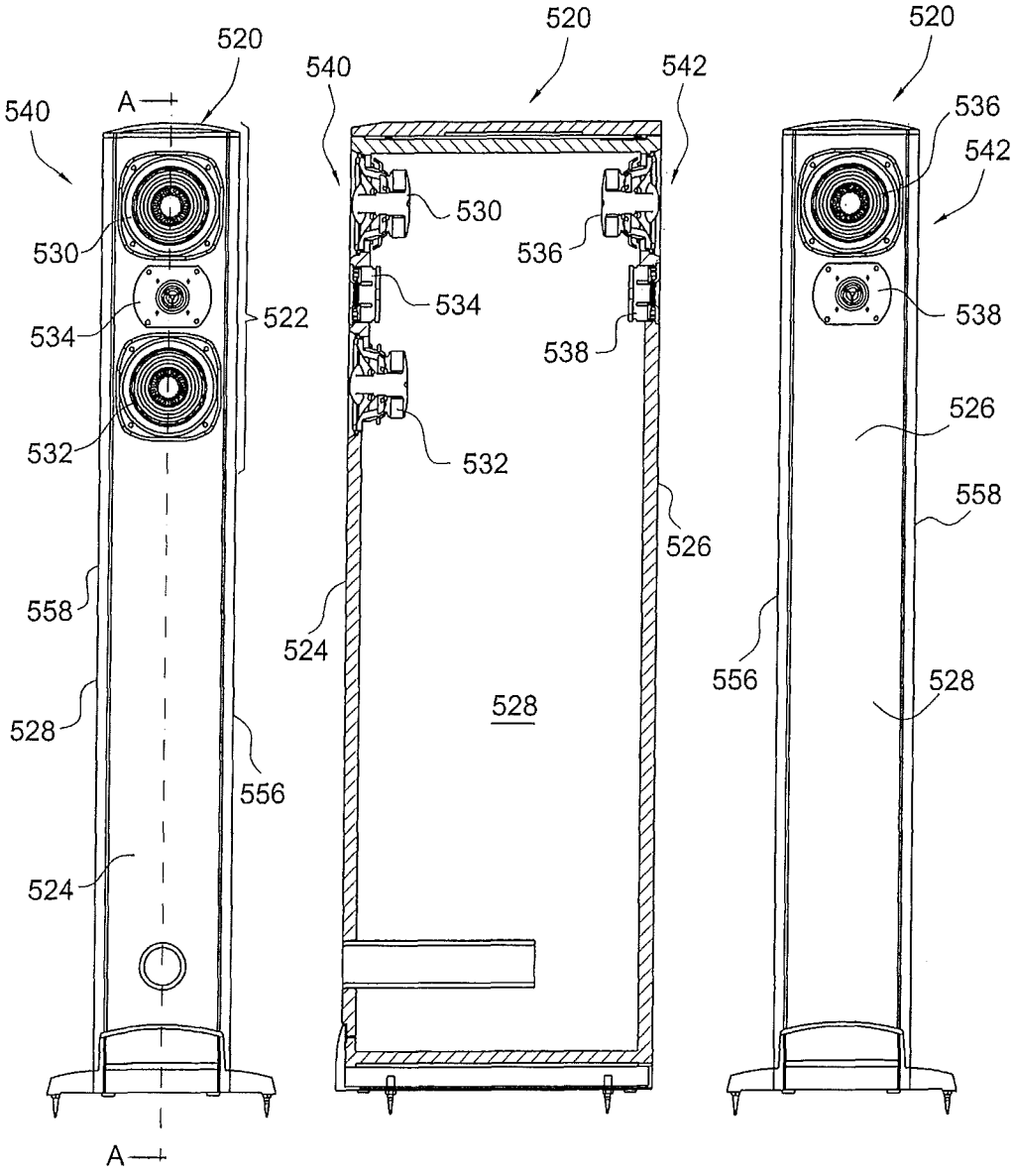
FIG. 21 is a front elevation view of another embodiment bipolar loudspeaker system enclosure in accordance with an alternative form of the present invention, illustrating two forward-facing bulbous-tip waveguide transducers.
FIG. 22 is a cross-sectional view of the speaker enclosure of FIG. 21, taken along line A-A of FIG. 21, illustrating the two forward-facing bulbous-tip waveguide transducers of FIG. 21, a rearward-facing bulbous-tip waveguide transducer, and a ported enclosure.
FIG. 23 is a rear elevation view of the speaker enclosure of FIG. 21, in accordance with the present invention.

Turning now to an alternative embodiment of the present invention, a loudspeaker system 520 exemplary of the invention is illustrated in FIGS. 21-23 as comprising a bipolar multi-driver loudspeaker system or assembly 522 mounted to project sound from the upper portions of the front and rear walls 524 and 526 of a generally rectangular tower-shaped speaker enclosure 528. As can be seen in FIGS. 21-23, a bass-reflex ported tower-shaped speaker enclosure 528 defines a box-shaped enclosure with a shared enclosure or chamber for a front-facing driver array 540 and a rear-facing driver array 542.

The assembly 522 in the illustrated embodiment includes an identical pair of front-facing mid-bass loudspeakers 530 and 532 with a tweeter 534 forming front-facing or forward speaker array, and a rear-facing mid-bass loudspeaker 536 with a tweeter 538 forming a rear speaker array. The loudspeakers in the front and rear arrays may be conventional acoustic loudspeaker drivers, also referred to as acoustic transducers, mounted in known manner on suitable baffles in the enclosure 528, it being understood that herein the term "drivers" refers to acoustic transducers or loudspeakers mounted to produce a selected range of output frequencies as is usual and intended for such mid-bass speakers and tweeters. As illustrated, the front speaker assembly or array is mounted in the front baffle 524 of enclosure 528, while the rear speaker assembly or array is mounted in the rear baffle 526 of enclosure 528, and a volume of enclosed air is disposed there-between comprising part of the system's ported enclosure volume 528.

Cabinet or enclosure 528 may optionally include one or more side-facing passive radiators (not shown) mounted via suitable baffles in one or both of the side walls 556 and 558 of the enclosure 528 in known manner. The bipolar loudspeaker embodiment is configured and tuned as described above, wherein the forward focussed bipolar speaker 520 has no side-firing subwoofer. In this embodiment, the 3 identical midranges are replaced by 3 identical bass-mid drivers (woofers) 530, 532 and 536, capable of playing bass frequencies. The three bass-mid drivers 530, 532 and 536 share the common cabinet volume and all 3 contribute to the bass frequencies. The 3 bass-mid drivers may be of the BDSS design (as described above) and advantageously employ the bulbous waveguide tip for more linear response. In the illustrated embodiment as best seen in cross sectional FIG. 22, the speaker is ported, but persons with skill in the art will appreciate that the forward focussed bipolar array may use any appropriate bass alignment, including, but not limited to sealed box, ported box, or ported with passive radiators. The passive forward focussed bipolar array 540 may be configured with any whole ratio of drivers (front array 540 to back array 542) such that the front SPL output shall be 2-10 dB greater than the rear output, as described above.

Figure 24:
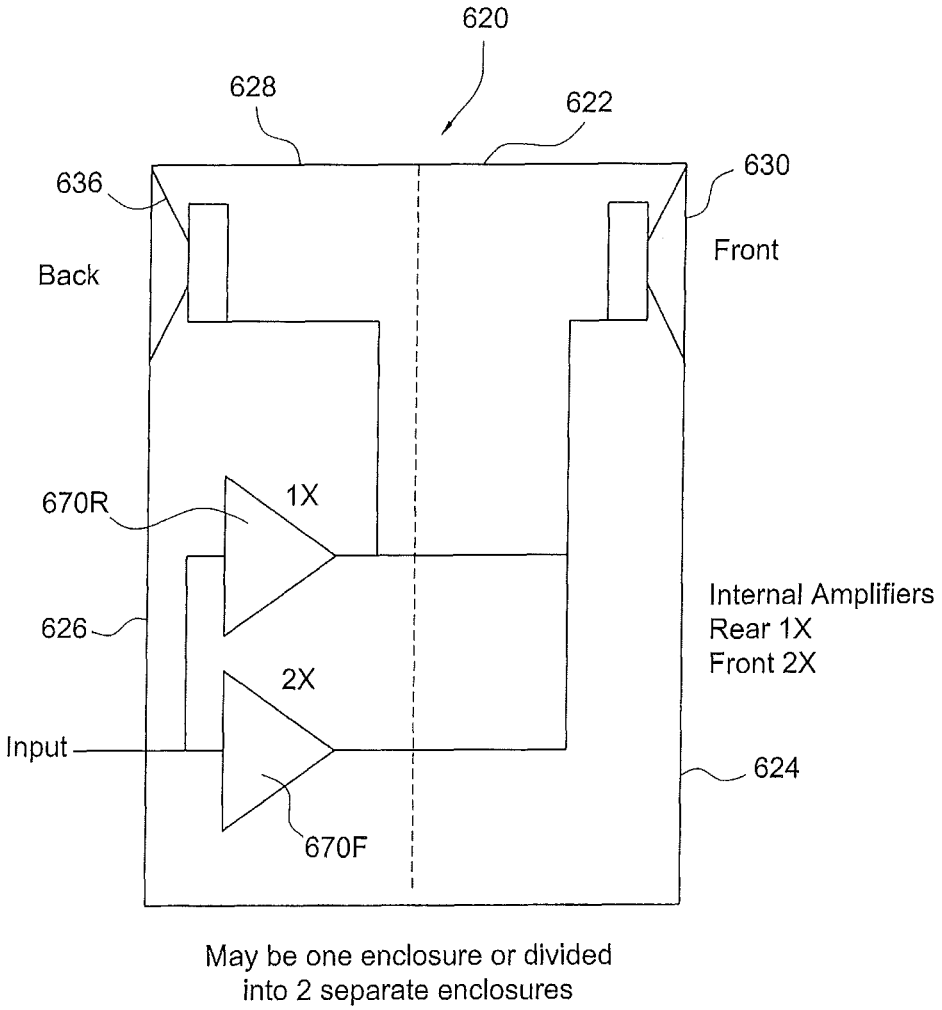
FIG. 24 is a schematic diagram illustrating another embodiment of the bipolar loudspeaker system in accordance with an alternative active amplifier/crossover form of the present invention, illustrating use of a first crossover/amplifier circuit driving a forward array including one or more forward-facing bulbous-tip waveguide transducers and a second crossover/amplifier circuit driving a rear array including one or more rear-facing bulbous-tip waveguide transducers, in accordance with the present invention.

Turning now to an alternative embodiment of the present invention, a loudspeaker system 620 exemplary of the invention is illustrated in FIG. 24 as comprising a bipolar multi-driver loudspeaker system or assembly 622 mounted to project sound from the upper portions of the front and rear walls of a generally rectangular tower-shaped speaker enclosure 528. This active bipolar loudspeaker system 620 substitutes active circuits with amplifiers for the passive crossover 70 used in the embodiments of FIGS. 1-8 or for a passive crossover (e.g., 70) in the embodiment of FIGS. 21-23. The embodiment of FIG. 24 is thus an alternative "active" amplifier/crossover form of the present invention, illustrating use of a first crossover/amplifier circuit 670F driving a forward driver array including one or more forward-facing drivers and a second crossover/amplifier circuit 670R driving a rear array including one or more rear-facing midrange speakers, in accordance with the present invention.

The assembly 622 in the illustrated embodiment includes at least one front-facing midrange or mid-bass loudspeaker 630 (optionally with a tweeter, not shown) forming front-facing or forward speaker array, and a rear-facing midrange or mid-bass loudspeaker 636 (optionally with a tweeter, not shown) forming a rear speaker array. The loudspeakers in the front and rear arrays may be conventional acoustic loudspeaker drivers, also referred to as acoustic transducers, mounted in known manner on suitable baffles in the enclosure 628, it being understood that herein the term "drivers" refers to acoustic transducers or loudspeakers mounted to produce a selected range of output frequencies as is usual and intended for such midrange or mid-bass speakers and tweeters. As illustrated, the front speaker assembly or array is mounted in the front baffle 624 of enclosure 628, while the rear speaker assembly or array is mounted in the rear baffle 626 of enclosure 628, and an optionally subdivided volume of enclosed air is disposed there-between comprising part of the system's enclosure volume.

Cabinet or enclosure 628 may optionally include one or more side-facing passive radiators (not shown) mounted via suitable baffles in one or both of the side walls of the enclosure 628 in known manner. Alternatively, the bipolar loudspeaker embodiment is configured and tuned as described above, wherein the forward focussed bipolar speaker 620 has no side-firing subwoofer. The front and rear array drivers 630, 636 may be of the BDSS design (as described above) and advantageously employ the bulbous waveguide tip for more linear response. As with the illustrated embodiment as in cross sectional FIG. 22, the enclosure 628 for active bipolar speaker 620 may be ported, but persons with skill in the art will appreciate that the active forward focussed bipolar array may use any appropriate bass alignment, including, but not limited to sealed box, ported box, or ported with passive radiators. The active forward focussed bipolar system's front array 630 and rear-facing array 636 may each be configured with any number drivers so long as the power levels are controlled such that the front SPL output shall be 2-10 dB greater than the rear output, as described above.

A prototype including individually adjustable dedicated front and rear amplifiers (e.g., 670F, 670R) were used in the development process to voice the bipolar speaker system of the present invention. First and second identical speakers (e.g., 630, 636) were configured back to back and the applicants adjusted the amplifier gain levels for 670F and 670R externally while measuring and listening to the resulting Bipolar loudspeaker system's sound, and it was discovered that the best measured and audible performance was obtained when the front array's SPL was double the rear array's SPL, as discussed above. It is intended that a selected front/read power ratio remain substantially fixed, preferably such that the front array's SPL was approximately double the rear array's SPL, as discussed above.

Optionally, the active embodiment of the forward focussed bipolar speaker system of the present invention 620 is configured to control the relative levels of the front/back SPL by adjusting the gain of separate amplifiers with individually adjusted volume/gain controls for the front speakers and back speakers. This embodiment may also be with or without a subwoofer. In this embodiment the front and back driver arrays may comprise any number of substantially identical drivers, with the front and rear amplifiers 670F, 670R adjusted such that the front array's SPL output shall be 2-10 dB greater than the rear array's output.

Broadly speaking, persons of skill in the art will recognize that the present invention makes available an improved front or forward focused bipolar loudspeaker system (e.g., 20, 520 or 620), comprising:

(a) a front-facing loudspeaker driver array including at least a first midrange or mid-bass driver mounted in a front baffle in an enclosure; the front-facing array further including at least a first tweeter driver mounted in the front baffle in the enclosure;

(b) a rear-facing loudspeaker driver array including at least a second midrange or mid-bass driver which is substantially identical to the front array's first driver, the second midrange or mid-bass driver being mounted in a rear baffle which opposes the enclosure's front baffle; said rear-facing array further including at least a second tweeter driver mounted in the enclosure's rear baffle;

(c) a crossover configured to receive an audio signal from an audio signal source and connected to the front array drivers and the rear array drivers;

(d) wherein the crossover, the front-facing array's drivers and the rear-facing array's drivers are interconnected to said audio signal source so that when an audio signal source (such as amplifier 60) provides the audio signal, the rear array's sound power is less than the front array's sound power by a selected forward focused power ratio being in the range of 2 dB-10 dB, thereby improving localization while retaining the spacious envelopment of a bipolar sound field.

Preferably, the improved bipolar loudspeaker system's front array drivers and rear array drivers are interconnected to audio signal source 60 so that when the audio signal source provides an audio signal, the rear array's sound power is less than the front array's sound power by a selected forward focused power ratio of one-to-two or 6 dB, thereby optimizing localization while retaining the spacious envelopment of a bipolar sound field.

Preferably, he improved bipolar loudspeaker system's front-facing array has substantially identical midrange or mid-bass drivers (such as driver 300) and the rear-facing array's midrange or mid-bass driver is substantially identical also.

In another preferred embodiment, as illustrated in FIGS. 1-8, the improved bipolar loudspeaker system 20 has the front-facing array's first and third substantially identical midrange or mid-bass drivers (30, 32) aligned vertically (e.g., as shown in FIGS. 1 and 2) with the first tweeter 34 in an M-T-M array, where the crossover 70 comprises a passive frequency dividing network configured and tuned to segregate the audio signal into:

(a) a front-facing array midrange or mid-bass driving signal, (b) a rear-facing array midrange or mid-bass driving signal having the same voltage level as said front-facing array midrange or mid-bass driving signal, (c) a front-facing array tweeter driving signal, (d) a rear-facing array tweeter driving signal which, compared to said front-facing array tweeter driving signal, is attenuated by said selected forward focused power ratio of one-to-two or 6 dB, and where exemplary driver connection polarity or signal phase relationships are illustrated in FIG. 9.

Optionally, the improved bipolar loudspeaker system has a crossover comprising an active frequency dividing network with separate amplifiers configured and tuned to segregate the audio signal into (670F) an amplified front-facing array driving signal, and (670R) an amplified rear-facing array driving signal having a selected power ratio compared to the front-facing array midrange or mid-bass driving signal such that, compared to said front-facing array driving signal, said rear-facing array driving signal is attenuated by the selected forward focused power ratio (e.g., 6 dB).

Although the bipolar loudspeaker system and the linear waveguide acoustic transducer of the present invention have been described in considerable detail, this was done for illustration purposes only. Neither the specific embodiments of the invention as a whole, nor those of its features limit the general principles underlying the invention. The specific features described herein may be used in some embodiments, but not in others, without departure from the spirit and scope of the invention as set forth. Various materials for transducer components also fall within the intended scope of the invention.

Many additional modifications are intended in the foregoing disclosure, and it will be appreciated by those of ordinary skill in the art that in some instances some features of the invention will be employed in the absence of a corresponding use of other features. The illustrative examples therefore do not define the metes and bounds of the invention and the legal protection afforded the invention, which function is carried out by the following claims and their equivalents.

What is claimed is:

1. An electrodynamic acoustic transducer configured for use in a loudspeaker system, comprising:

a pole piece comprising a first or distal end;

a voice coil comprising wire windings configured to receive electrical current, the voice coil being configured to move along the first end of the pole piece;

a magnetic structure comprising parts defining an air gap, wherein the voice coil on the first end of the pole piece is disposed in the air gap so that the magnetic structure creates a magnetic field in which the voice coil is configured to move along the first end of the pole piece;

a first diaphragm comprising an inner periphery defining a central opening and an outer periphery, the inner periphery of said first diaphragm being attached to the voice coil to move with the voice coil; and a waveguide extension structure disposed on the first end of the pole piece, said waveguide extension having a bulbous tip that projects radially to a larger diameter than the pole to project laterally over the inner radiating area of said first diaphragm.

2. The electrodynamic acoustic transducer according to claim 1, wherein the bulbous tip waveguide extension is configured to substantially attenuate high frequency sound radiation from the central portion of said first diaphragm.

3. The electrodynamic acoustic transducer according to claim 2, wherein the bulbous tip waveguide extension is configured to substantially absorb high frequency sound radiation from the central portion of said first diaphragm.

4. The electrodynamic acoustic transducer according to claim 3, wherein said first diaphragm's inner periphery incorporates an inner flexible roll seal.

5. The electrodynamic acoustic transducer according to claim 4, wherein the bulbous tip waveguide extension is porous and said bulbous tip waveguide extension comprises a portion that reduces in diameter in a smooth arc.

6. The electrodynamic acoustic transducer according to claim 5, wherein the bulbous tip waveguide extension of the pole ascends to a height substantially no less than height of said first diaphragm with the voice coil at rest, and substantially no more than height of said first diaphragm at maximum excursion.

7. The electrodynamic acoustic transducer according to claim 6, wherein said waveguide extension structure includes a first coaxially aligned portion of a first diameter, a second coaxially aligned portion of a second diameter, and a third coaxially aligned, radially projecting larger diameter bulbous tip; and wherein said second diameter is slightly smaller than the first diameter, so that a coaxial annular ledge is formed at the interface of the two portions, and wherein said first, second or third diameters are larger than the diameter of the coaxial pole piece.

8. An improved loudspeaker system, comprising:

at least one front-facing midrange or mid-bass bulbous-tip waveguide transducer mounted in a baffle in an enclosure to create a loudspeaker assembly;

said bulbous-tip waveguide transducer comprising a pole piece comprising a first end;

a voice coil comprising wire windings configured to receive electrical current, the voice coil being configured to move along the first end of the pole piece; a magnetic structure comprising parts defining an air gap, wherein the voice coil on the first end of the pole piece is disposed in the air gap so that the magnetic structure creates a magnetic field in which the voice coil is configured to move along the first end of the pole piece; a first diaphragm comprising an inner periphery defining a central opening and an outer periphery, the inner periphery of said first diaphragm being attached to the voice coil to move with the voice coil; and a waveguide extension structure disposed on the first end of the pole piece, said waveguide extension having a bulbous tip that projects radially to a larger diameter than to project laterally over the inner radiating area of said first diaphragm.

9. The improved loudspeaker system according to claim 8, wherein the bulbous tip waveguide extension is configured to substantially attenuate high frequency sound radiation from the central portion of said first diaphragm.

10. The improved loudspeaker system according to claim 9, wherein the bulbous tip waveguide extension is configured to substantially absorb high frequency sound radiation from the central portion of said first diaphragm.

11. The improved loudspeaker system according to claim 10, wherein said first diaphragm's inner periphery incorporates an inner flexible roll seal.

12. The improved loudspeaker system according to claim 11, wherein the bulbous tip waveguide extension is porous and said bulbous tip waveguide extension comprises a portion that reduces in diameter in a smooth arc.

13. The improved loudspeaker system according to claim 12, wherein the bulbous tip waveguide extension of the pole ascends to a height substantially no less than height of said first diaphragm with the voice coil at rest, and substantially no more than height of said first diaphragm at maximum excursion.

14. The improved loudspeaker system according to claim 13, wherein said waveguide extension structure includes a first coaxially aligned portion of a first diameter, a second coaxially aligned portion of a second diameter, and a third coaxially aligned, radially projecting larger diameter bulbous tip; and wherein said second diameter is slightly smaller than the first diameter, so that a coaxial annular ledge is formed at the interface of the two portions, and wherein said first, second or third diameters are larger than the diameter of the coaxial pole piece.

15. The improved loudspeaker system according to claim 10, wherein said bulbous waveguide tip blocks sound radiation coming from said inner radiating area of said first diaphragm.

16. The improved loudspeaker system according to claim 15, wherein said blocked radiation coming from said inner radiating area of said first diaphragm is prevented by said bulbous waveguide tip from creating destructive interference with sound radiation from an outer radiating area of said first diaphragm.

17. The improved loudspeaker system according to claim 15, wherein said loudspeaker improvements' effect, as compared to traditional loudspeakers, is reduced high frequency distortions caused by destructive interference within the transducer.

18. The improved loudspeaker system according to claim 15, wherein said bulbous tip's effect, as compared to traditional loudspeakers, is to extend the useful frequency response by approximately ⅔ of an octave in the crucial crossover frequency band of 2 kHz to 4 kHz;

wherein the reduced high frequency distortion and a related frequency extension with the tip provides smoother response with steeper roll-off than without the tip, thereby providing a loudspeaker which makes well-behaved crossover design more straightforward.

* * * * *